US012023783B2

(12) United States Patent
Everts et al.

(10) Patent No.: US 12,023,783 B2
(45) Date of Patent: Jul. 2, 2024

(54) ABRASIVE ARTICLES INCLUDING A BLEND OF ABRASIVE PARTICLES AND METHOD OF FORMING AND USING THE SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Darrell K. Everts, Schenectady, NY (US); Doruk O. Yener, Bedford, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 17/650,280

(22) Filed: Feb. 8, 2022

(65) Prior Publication Data

US 2022/0161392 A1 May 26, 2022

Related U.S. Application Data

(63) Continuation of application No. 16/119,522, filed on Aug. 31, 2018, now Pat. No. 11,260,504.

(60) Provisional application No. 62/553,031, filed on Aug. 31, 2017.

(51) Int. Cl.

| | |
|---|---|
| ***B24D 3/34*** | (2006.01) |
| ***B24D 3/28*** | (2006.01) |
| ***B24D 11/02*** | (2006.01) |
| ***B24D 18/00*** | (2006.01) |

(52) U.S. Cl.

CPC ..... *B24D 3/344* (2013.01); *B24D 3/28* (2013.01); *B24D 11/02* (2013.01); *B24D 18/0018* (2013.01); *B24D 18/0072* (2013.01)

(58) Field of Classification Search

CPC ..... B24D 3/344; B24D 3/28; B24D 11/02; B24D 18/0072

See application file for complete search history.

(56) References Cited

U.S. PATENT DOCUMENTS

| | | | |
|---|---|---|---|
| 3,765,132 | A | 10/1973 | Mackey et al. |
| 4,314,827 | A | 2/1982 | Leitheiser et al. |
| 4,734,104 | A | 3/1988 | Broberg |
| 4,744,802 | A | 5/1988 | Schwabel |

(Continued)

FOREIGN PATENT DOCUMENTS

| | | | |
|---|---|---|---|
| WO | 1999006500 | A1 | 2/1999 |
| WO | 2010002493 | A1 | 1/2010 |
| WO | 2015160857 | A1 | 10/2015 |

*Primary Examiner* — Pegah Parvini

(74) *Attorney, Agent, or Firm* — Abel Schillinger, LLP; Arpan Ghosh

(57) ABSTRACT

An abrasive article including a substrate; and an abrasive layer overlying the substrate, where the abrasive layer includes a blend of abrasive particles including a first type of abrasive particle comprising a polycrystalline material and having a first average friability $F_1$, and a second type of abrasive particle comprising a polycrystalline material and having a second average friability, $F_2$, where the blend comprises an average friability difference, $\Delta F=|F_1-F_2|$, within a range of at least 0.5% to not greater than 80%.

18 Claims, 15 Drawing Sheets

(56) References Cited

U.S. PATENT DOCUMENTS

| | | | | |
|---|---|---|---|---|
| 5,007,943 | A | 4/1991 | Kelly et al. | |
| 5,185,012 | A * | 2/1993 | Kelly | B24D 11/00 51/298 |
| 6,451,077 | B1 | 9/2002 | Rosenflanz | |
| 9,221,151 | B2 | 12/2015 | Seth | |
| 2014/0150766 | A1 | 6/2014 | Che et al. | |
| 2015/0267097 | A1 | 9/2015 | Rosenflanz et al. | |
| 2015/0291867 | A1 | 10/2015 | Breder et al. | |

* cited by examiner

ABRASIVE ARTICLES INCLUDING A BLEND OF ABRASIVE PARTICLES AND METHOD OF FORMING AND USING THE SAME

CROSS-REFERENCE TO RELATED APPLICATION

This application is a continuation of and claims priority under 35 U.S.C. § 120 to U.S. patent application Ser. No. 16/119,522, entitled "ABRASIVE ARTICLES INCLUDING A BLEND OF ABRASIVE PARTICLES AND METHOD OF FORMING AND USING THE SAME", by Darrell K. EVERTS, et al., filed Aug. 31, 2018, which claims priority under 35 U.S.C. § 119(e) to U.S. Provisional Application No. 62/553,031, entitled "ABRASIVE ARTICLES INCLUDING A BLEND OF ABRASIVE PARTICLES AND METHOD OF FORMING AND USING THE SAME", by Darrell K. EVERTS, et al., filed Aug. 31, 2017, both of which are assigned to the current assignee hereof and incorporated herein by reference in their entireties.

FIELD OF THE INVENTION

The following is generally directed to abrasive articles and methods of making and use of the same that include a blend of abrasive grains.

BACKGROUND

Abrasive articles have been used to abrade and finish work-piece surfaces. Abrasive articles are used in various industries to machine work pieces, such as by lapping, grinding, and polishing. Further, surface processing using abrasive articles spans a wide industrial scope from initial coarse material removal to high precision finishing and polishing of surfaces at a submicron level.

In general, abrasive articles comprise a type of abrasive particles bonded either together (e.g., a bonded abrasive or grinding wheel) or to a backing (e.g., a coated abrasive article). For a coated abrasive article, there is typically a single layer, or sometimes a plurality of layers, of abrasive particles bonded to the backing. The abrasive particles can be bonded to the backing with a "make" coat and "size" coat, or as a slurry coat. Further, a supersize coat can be applied on the make coat or size coat to help extend the life of the abrasive particles.

Generally, the performance of an abrasive article is affected by the abrasive particles that make up the abrasive surface or abrasive layer of the abrasive article. Although many types of abrasive surfaces and abrasive layers are known for use in abrasive articles, there is still a need in the art for improved abrasive surfaces and improved abrasive layers. As a result, there continues to be a demand for improved abrasive products and methods that can offer enhanced abrasive processing performance, efficiency, and improved surface quality.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
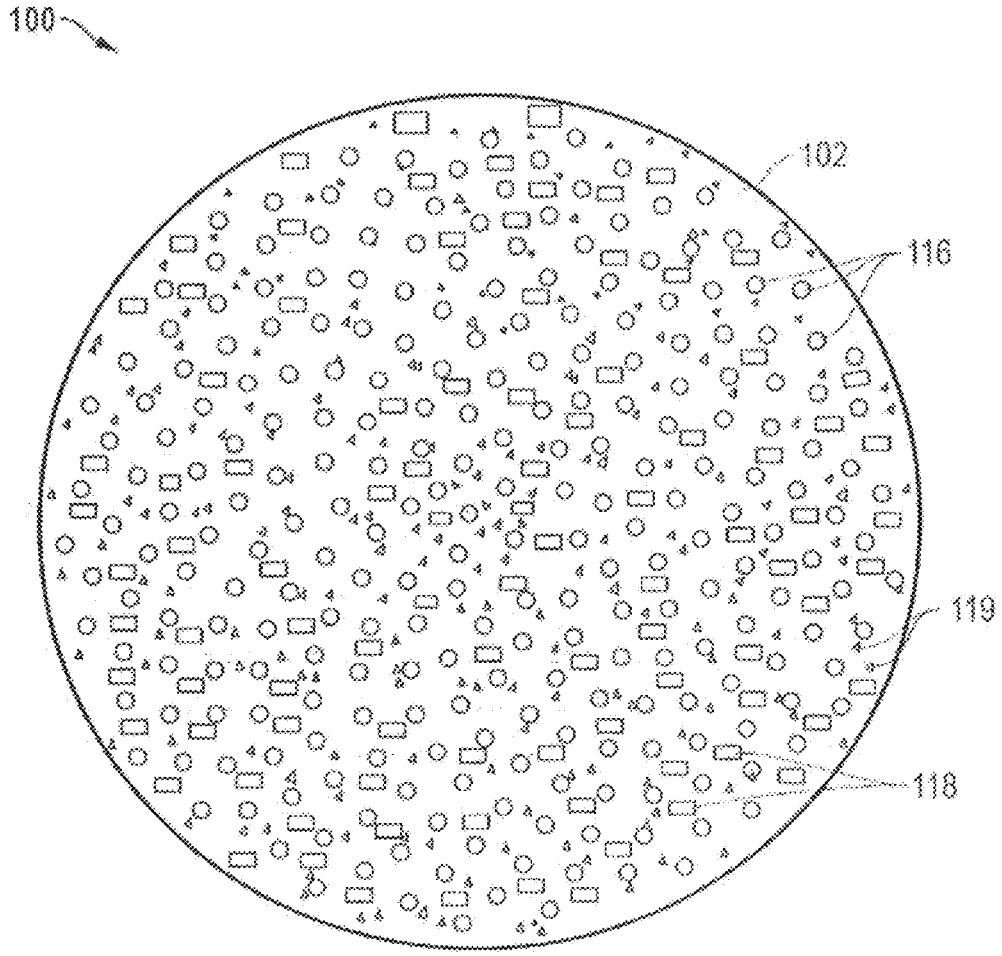
FIG. 1 is an illustration of an embodiment of an abrasive article that includes a blend of abrasive particles.

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the abrasive arts.

Abrasive Article

Referring initially to FIG. 1, an abrasive article 100 is illustrated. The abrasive article 100 may be a coated abrasive. As depicted in FIG. 1, the abrasive article 100 can include a body 102 that, in a particular non-limiting example, can be generally circular. The body 102 of the abrasive article 100 may include a blend of abrasive particles 116, 118, 119. It can be appreciated that the body 102 of the abrasive article 100 may have any other shape or form that is well known to one of ordinary skill in the art. For example, that shape may be triangular, square, rectangular, etc., while the form could be a disc, belt, sheet, wheel, film, pad, etc. The shape may also be three-dimensional. Regarding FIG. 1, the sizes and shapes of the particles 116, 118, 119 are illustrative in nature and not meant to indicate actual particle shape, size, or spacing.

Figure 2:
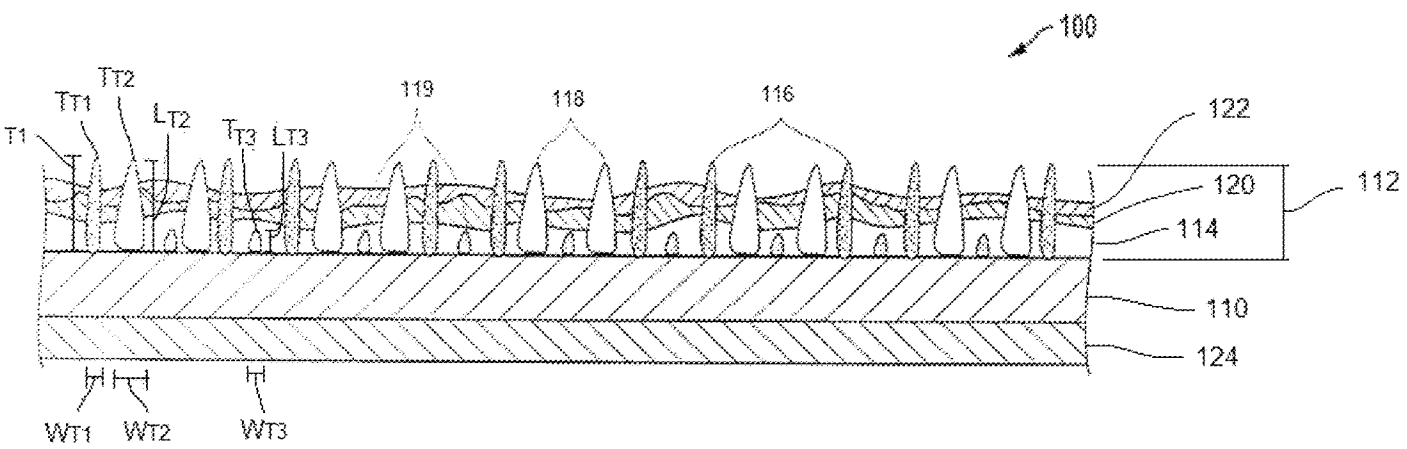
FIG. 2 is an illustration of a cross-sectional view of an embodiment of an abrasive article that includes a blend of abrasive particles.

FIG. 2 shows an illustration of a cross-section of the body 102 of the abrasive article 100 embodiment. As indicated in FIG. 2, the body 102 of the abrasive article can include a backing material or substrate 110 on which an abrasive layer 112 can be disposed. The abrasive layer 112 may include a polymeric binder layer 114 (also called herein a "make coat" or make coat layer) disposed on the backing material 110. In a number of embodiments a first type of abrasive particles 116 may be dispersed on or in the polymeric binder layer 114. Moreover, a second type of abrasive particles 118 may be dispersed on or in the polymeric binder layer 114. Further, additive particles 119 may be dispersed on or in the polymeric binder layer 114. The first type of abrasive particles 116 may have an abrasive characteristic that is different than the second type of abrasive particles 118. The first type of abrasive particles 116 may have an abrasive characteristic that is different than the additive particles 119. The second type of abrasive particles 118 may have an abrasive characteristic that is different than the additive particles 119. Accordingly, the abrasive article 100 can include a blend of abrasive particles 116, 118, 119 which will be described in greater detail herein.

Further, as indicated in FIG. 2, a size coat layer 120 can be disposed on the abrasive layer 112. A supersize coat layer 122 may be disposed on the size coat layer 120. In a particular embodiment, as indicated in FIG. 2, the body 102 of the abrasive article 100 may further optionally include a tool attachment layer 124 disposed on a surface of the body 102 opposite the previously described layers, i.e., the abrasive layer 112, the size coat layer 120, and the supersize coat layer 122.

Figure 3:
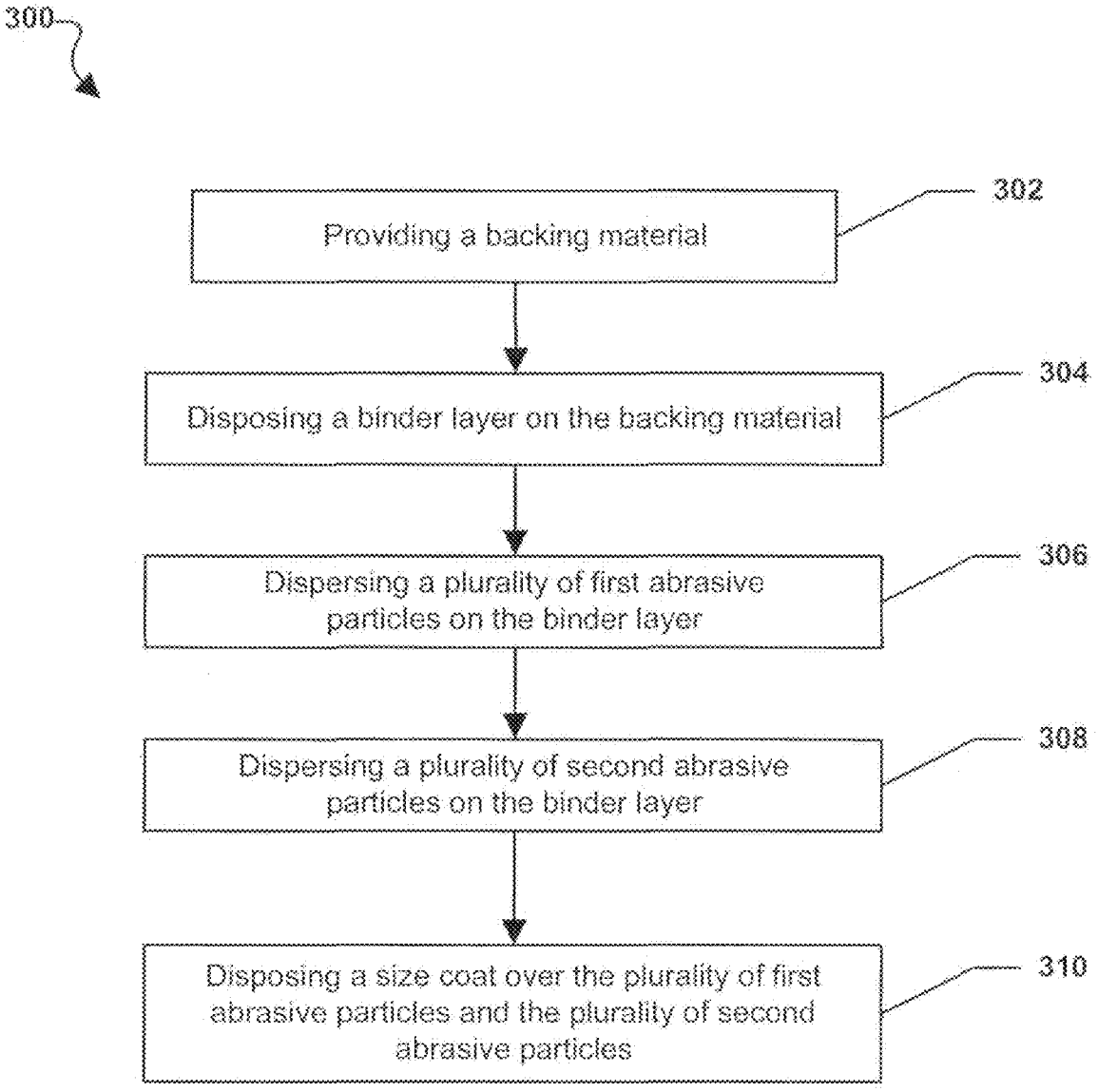
FIG. 3 is an illustration of a flowchart of an embodiment of a method of making an abrasive article having a blend of abrasive particles.

FIG. 3 is an illustration of a flowchart of an embodiment of a method 300 of making an abrasive article having a blend of abrasive particles. At step 302, the method 300 includes providing a backing material. At step 304, the method 300 includes disposing a binder layer on the backing material. Moving to step 306, the method includes dispersing a plurality of a first type of abrasive particles on the binder layer. Further, at step 308, the method 300 includes dispersing a plurality of a second type of abrasive particles on the binder layer. Further, at step 310, the method 300 includes dispersing a plurality of additive particles or a third type of abrasive particles on the binder layer. At step 312, the method 300 includes disposing a size coat over the plurality of a first type of abrasive particles, the plurality of a second type of abrasive particles, and the plurality of a third type of abrasive particles. In a number of embodiments, the method 300 may optionally include the third type of abrasive particles (i.e., the method may include only the blend of the first type of abrasive particles and the second type of abrasive particles).

Figure 4:
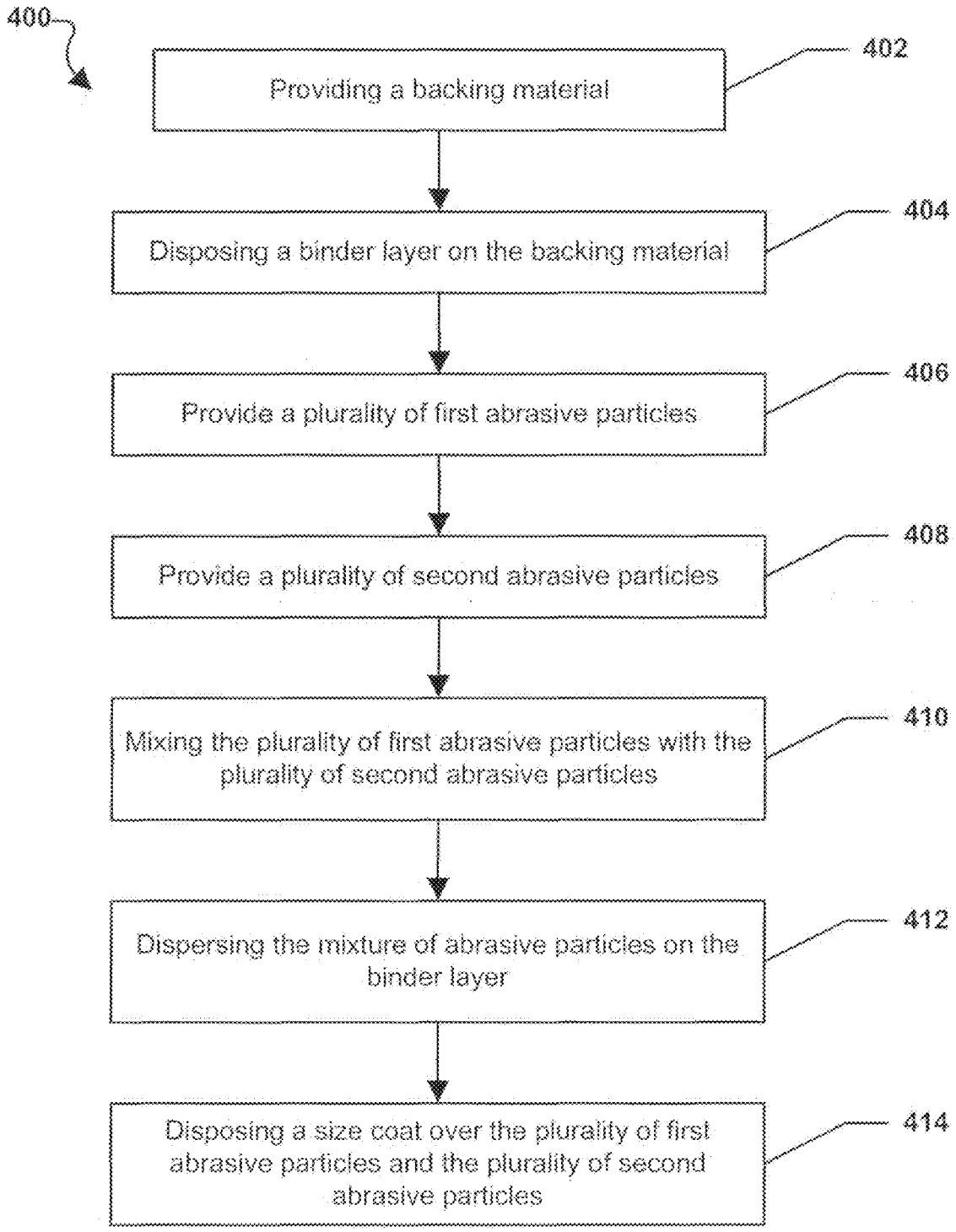
FIG. 4 is an illustration of a flowchart of another embodiment of a method of making an abrasive article having a blend of abrasive particles.

FIG. 4 is an illustration of a flowchart of another embodiment of a method 400 of making an abrasive article having a blend of abrasive particles. At step 402, the method 400 includes providing a backing material. At step 404, the method 300 includes disposing a binder layer on the backing material. Continuing to step 406, the method includes proving a plurality of a first type of abrasive particles. At step 408, the method 400 includes providing a plurality of a second type of abrasive particles. At step 410, the method 400 includes providing a plurality of a third type of abrasive particles. At step 412, the method 400 includes mixing the plurality of a first type of abrasive particles with the plurality of a second type of abrasive particles and a plurality of a third type of abrasive particles. Moving to step 412, the method 400 includes dispersing the mixture of abrasive particles on the binder layer. At step 414, the method 400 includes disposing a size coat over the plurality of a first type of abrasive particles, the plurality of a second type of abrasive particles and the plurality of a third type of abrasive particles. In a number of embodiments, the method 400 may optionally include the third type of abrasive particles (i.e., the method may include only the blend of the first type of abrasive particles and the second type of abrasive particles).

Figure 5:
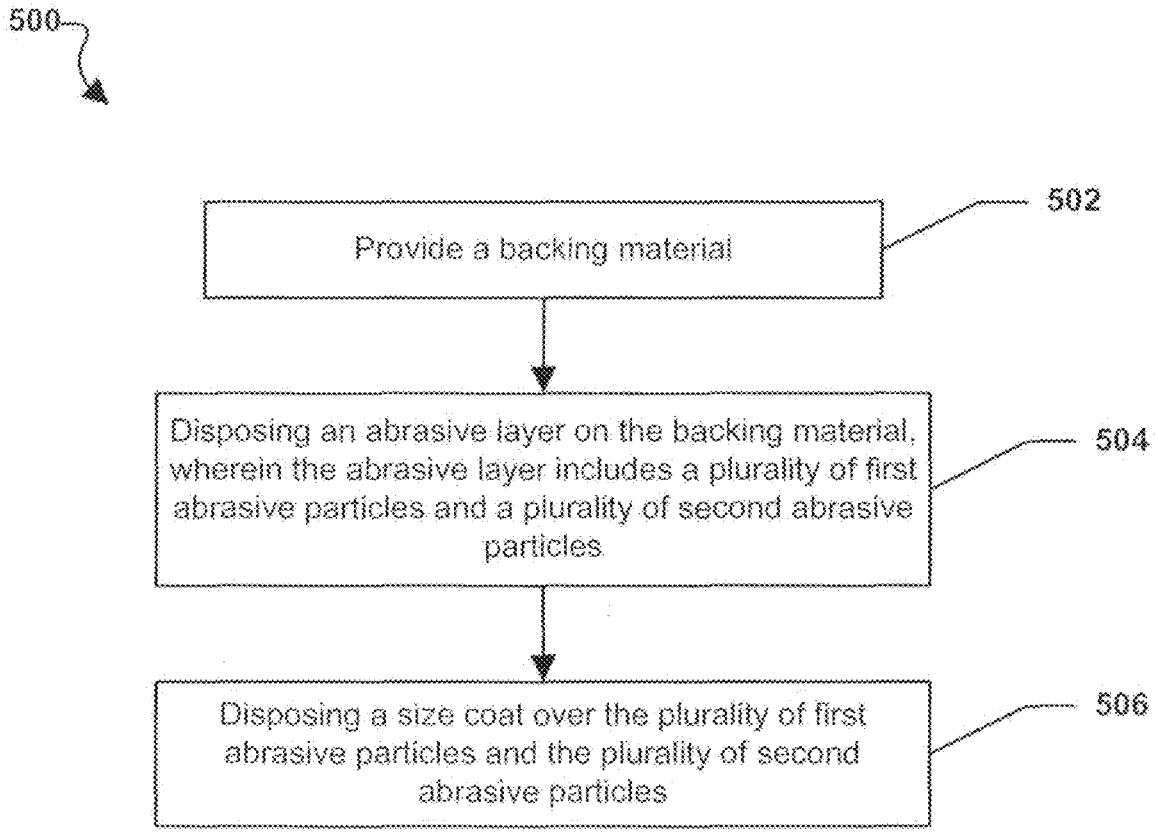
FIG. 5 is an illustration of a flowchart of yet another embodiment of a method of making an abrasive article having a blend of abrasive particles.

FIG. 5 is an illustration of a flowchart of still another embodiment of a method 500 of making an abrasive article having a blend of abrasive particles. At step 502, the method 500 includes providing a backing material. At step 504, the method 500 includes disposing an abrasive layer on the backing material. The abrasive layer includes a plurality of a first type of abrasive particles, a plurality of a second type of abrasive particles, and a plurality of a third type of abrasive particles. Moving to step 506, the method 500 includes disposing a size coat over the plurality of a first type of abrasive particles, the plurality of a second type of abrasive particles, and a third type of abrasive particles. In a number of embodiments, the method 500 may optionally include the third type of abrasive particles (i.e., the method may include only the blend of the first type of abrasive particles and the second type of abrasive particles).

Backing Material

In a particular embodiment, the backing material 110 (also referred to herein as "a backing") can be flexible or rigid. The backing 110 can be made of a suitable material having the proper combination of desired physical, chemical, mechanical, and/or performance properties and/or features to produce advantageous abrasive performance in combination with a blend of abrasive particles as described in greater detail herein. Suitable backing materials can include a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, rayon, or combinations thereof); paper; vulcanized paper; vulcanized rubber; vulcanized fiber; nonwoven materials; a combination thereof; or a chemically treated version thereof. Cloth backings can be woven or stitch bonded. In particular examples, the backing may be selected from the group consisting of paper, polymer film, cloth (e.g., cotton, poly-cotton, rayon, polyester, poly-nylon), vulcanized rubber, vulcanized fiber, metal foil, and a combination thereof.

The backing can optionally have at least one of a saturant, a presize layer (also called a "front fill layer"), or a backsize layer (also called a "back fill layer"). The purpose of these layers is typically to seal the backing or to protect yarn or fibers in the backing. If the backing is a cloth material, at least one of these layers may typically be used. The addition of the presize layer or backsize layer can additionally result in a "smoother" surface on either the front or the back side of the backing. Other optional layers known in the art can also be used such as a tie layer.

In a particular embodiment, the backing material can comprise a woven polyester cloth fabric. The woven polyester cloth fabric can comprise a 1-ply fabric or multi-ply fabric, such as a 2-ply fabric. As used herein, "2-ply" indicates a fabric comprising 2-ply threads. In a specific embodiment, the backing includes a saturant composition.

The backing can possess a particular "weight" (mass per unit area), such as g/m$^2$ (abbreviated herein as "GSM") useful for providing an abrasive belt, disc, sheet, or other appropriate article, such as from 5 GSM to 200 GSM. In an embodiment, the backing comprises a backing weight of not less than 5 GSM, such as not less than 10 GSM, not less than 15 GSM, or not less than 20 GSM. In an embodiment, the backing comprises a backing weight of not greater than 200 GSM, not greater than 150 GSM, such as not greater than 100 GSM, not greater than 50 GSM, not greater than 40 GSM, or not greater than 30 GSM. The weight of the backing can be within a range comprising any pair of the previous upper and lower limits. In a particular embodiment, the weight of the backing can be in the range of not less than 10 GSM to not greater than 50 GSM, such as not less than 15 GSM to not greater than 40 GSM, not less than 20 GSM to not greater than 30 GSM.

The backing can have any thickness useful for providing an appropriate abrasive article, such as about 0.05 millimeters to about 1 millimeter.

An embodiment, a saturating composition is applied onto or into the backing. The saturating composition can include a curable latex polymeric binder, a film forming resin, and optional additional components.

The amount of the saturating composition applied may vary depending on the desired properties of the backing, such as the desired permeability. Typically, the saturating composition is present at an add-on level of about 10% to about 100%, and in some embodiments, from about 40% to about 80%. The add-on level is calculated by dividing the dry weight of the saturating composition applied by the dry weight of the backing before treatment, and multiplying the result by 100.

In an embodiment, the saturated backing can be calendered after saturation. Calendering the saturated backing can increase the softness and smoothness of the sheet.

A top coating may be applied, in certain embodiments, onto the backing. The top coating can be a film forming coating, a barrier coating, a semi-porous coating, etc. The top coating can be a barrier coating applied onto the backing following saturation.

Particularly suitable latex polymeric binders are those that adhere or bond well to the saturated, backing. For example, one particularly suitable latex polymeric binder for the barrier coating can include an acrylic latex binder.

The backing material can have a particular strength (such as a tensile strength, or particular type of tear strength (e.g., Elmendorf tear strength) in the machine direction (MD strength). In an embodiment, the strength of the backing in the machine direction can be not less than 135 g force, not less than 150 g force, not less than 200 g force, not less than 250 g force, not less than 300 g force, or not less than 350 g force. In another embodiment, the strength of the backing in the machine direction can be not greater than 550 g force, not greater than 500 g force, not greater than 450 g force, or not greater than 400 g force. The strength of the backing can be within a range comprising any pair of the previous upper and lower limits. In a particular embodiment, the strength of the backing in the machine direction can be in a range of not less than 150 g force to not greater than 550 g force, such as 200 g force to 500 g force, such as 250 g force to 450 g force, or 300 g force to 400 g force.

The backing material can have a particular strength (such as a tensile strength, or particular type of tear strength (e.g., Elmendorf tear strength) in the cross direction (CD strength). In an embodiment, the strength of the backing in the cross direction can be not less than 150 g force, not less than 200 g force, not less than 250 g force, not less than 300 g force, not less than 350 g force, or not less than 400 g force. In another embodiment, the strength of the backing in the cross direction can be not greater than 650 g force, not greater than 600 g force, not greater than 550 g force, or not greater than 500 g force. The strength of the backing can be within a range comprising any pair of the previous upper and lower limits. In a particular embodiment, the strength of the backing in the cross direction can be in a range of not less than 150 g force to not greater than 650 g force, such as 200 g force to 600 g force, such as 250 g force to 550 g force, or 300 g force to 500 g force.

The backing material can have a particular relationship of the strength (such as a tensile strength, or particular type of tear strength (e.g., Elmendorf tear strength) in the cross direction (CD strength) compared to the strength (Elmendorf tear strength) in the machine direction (MD strength). In an embodiment, the strength in the cross direction (CD strength) is at least equal to the strength in the machine direction (MD strength). In another embodiment, the strength in the cross direction (CD strength) is greater than the strength in the machine direction (MD strength). The relationship of the CD strength to the MD strength can be expressed as a ratio or as a percentage.

In an embodiment, the ratio of MD strength to CD strength ($MD_{strength}$:$CD_{strength}$) of the backing material can vary. In an embodiment, the ratio $MD_{strength}$:$CD_{strength}$ can be not less than 1:4, not less than 1:3.5, not less than 1:3, or not less than 1:2.5. In another embodiment, the ratio $MD_{strength}$:$CD_{strength}$ can be not greater than 1:1, such as not greater than 1:1.05, not greater than 1:1.1, or not greater than 1:1.15. The strength of the backing material can be within a range comprising any pair of the previous upper and lower limits. In a particular embodiment, the ratio $MD_{strength}$:$CD_{Strength}$ can be in a range from 1:1 to 1:4, such as 1.1.05 to 1:4.

Abrasive Layer

As described above, the abrasive layer 112 includes the first type of abrasive particles 116, the second type of abrasive particles 118, and optionally the additive particles 119 disposed on, or dispersed in, the polymeric binder layer 114 composition. In a number of embodiments, the first type of abrasive particles 116, the second type of abrasive particles 118, and optionally the additive particles 119 may form a blend of abrasive particles.

In a number of embodiments, the abrasive layer 112 includes a blend of abrasive particles including a first type of abrasive particle 116 having a first average friability $F_1$, and a second type of abrasive particle 118 having a second average friability, $F_2$, wherein the blend comprises a average friability difference, $\Delta F_1=|F_1-F_2|$, within a range of at least 0.1%, at least 0.5%, at least 1%, at least 5%, at least 10%, at least 25%, at least 50%, at least 75%, or at least 80%. In a number of embodiments, the abrasive layer 112 includes a blend of abrasive particles including a first type of abrasive particle 116 having a first average friability $F_1$, and a second type of abrasive particle 118 having a second average friability, $F_2$, wherein the blend comprises a average friability difference, $\Delta F_1=|F_1-F_2|$, within a range of no greater than 80%, no greater than 75%, no greater than 50%, no greater than 25%, no greater than 10%, no greater than 5%, or no greater than 1%. In a number of embodiments, the abrasive layer 112 includes a blend of abrasive particles including a first type of abrasive particle 116 having a first average friability $F_1$, and a second type of abrasive particle 118 having a second average friability, $F_2$, wherein the blend comprises a average friability difference, $\Delta F_1=|F_1-F_2|$, within a range of at least 0.1% to not greater than 80%. The difference of the average friabilities can be computed as a fixed value or as a percentage.

In a number of embodiments, the abrasive layer 112 includes a blend of abrasive particles including a first type of abrasive particle 116 having a first average friability $F_1$, and a third type of abrasive particle 119 having a third average friability, $F_3$, wherein the blend comprises a average friability difference, $\Delta F_2=|F_1-F_3|$, within a range of at least 0.1%, at least 0.5%, at least 1%, at least 5%, at least 10%, at least 25%, at least 50%, at least 75%, or at least 90%. In a number of embodiments, the abrasive layer 112 includes a blend of abrasive particles including a first type of abrasive particle 116 having a first average friability $F_1$, and a third type of abrasive particle 119 having a third average friability, $F_3$, wherein the blend comprises a average friability difference, $\Delta F_2=|F_1-F_3|$, within a range of no greater than 90%, no greater than 75%, no greater than 50%, no greater than 25%, no greater than 10%, no greater than 5%, or no greater than 1%. In a number of embodiments, the abrasive layer 112 includes a blend of abrasive particles including a first type of abrasive particle 116 having a first average friability $F_1$, and a third type of abrasive particle 119 having a third average friability, $F_3$, wherein the blend comprises a average friability difference, $\Delta F_2=|F_1-F_3|$, within a range of at least 0.1% to not greater than 90%.

In a number of embodiments, the abrasive layer 112 includes a blend of abrasive particles including a second type of abrasive particle 116 having a second average friability $F_2$, and a third type of abrasive particle 119 having a second average friability, $F_3$, wherein the blend comprises a average friability difference, $\Delta F_3=|F_2-F_3|$, within a range of at least 0.1%, at least 0.5%, at least 1%, at least 5%, at least 10%, at least 25%, at least 50%, at least 75%, or at least 90%. In a number of embodiments, the abrasive layer 112 includes a blend of abrasive particles including a second type of abrasive particle 116 having a second average friability $F_2$, and a third type of abrasive particle 119 having a second average friability, $F_3$, wherein the blend comprises a average friability difference, $\Delta F_3=|F_2-F_3|$, within a range of no greater than 90%, no greater than 75%, no greater than 50%, no greater than 25%, no greater than 10%, no greater than 5%, or no greater than 1%. In a number of embodiments, the abrasive layer 112 includes a blend of abrasive particles including a second type of abrasive particle 116 having a second average friability $F_2$, and a third type of abrasive particle 119 having a second average friability, $F_3$, wherein the blend comprises a average friability difference, $\Delta F_3=|F_2-F_3|$, within a range of at least 0.1% to not greater than 90%.

In a number of embodiments, the abrasive layer 112 may include a first region 112*a* (or "make coat") and a second region 112*b* (or "size coat") overlying the first region 112*a*. In a number of embodiments, the blend of the first type of abrasive particles 116, the second type of abrasive particles 118, and optionally the additive particles 119 may be disposed entirely in the second region 11*b*. In a number of embodiments, the blend of the first type of abrasive particles 116, the second type of abrasive particles 118, and optionally the additive particles 119 may be disposed entirely in the first region 11*a*. In a number of embodiments, the blend of the first type of abrasive particles 116 and the second type of abrasive particles 118 may be disposed in the entirely second region 11*b* while the additive particles 119 may be disposed in the first region 112*a*.

First Type of Abrasive Particles

The first type of abrasive particles 116 can include essentially single phase inorganic materials, such as alumina, silicon carbide, silica, ceria, and harder, high performance superabrasive particles such as cubic boron nitride and diamond. Additionally, the first type of abrasive particles 116 can include composite particulate materials. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures.

The first type of abrasive particles 116 can be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the first type of abrasive particles 116 can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense first type of abrasive particles 116 comprised principally of alpha-alumina. In a number of embodiments, the first type of abrasive particles 116 can include a polycrystalline material. In a number of embodiments, the first type of abrasive particles 116 can consist essentially of alumina.

The first type of abrasive particle 116 can also have a particular shape. An example of such a shape includes a rod, a triangle, a pyramid, a cone, a solid sphere, a hollow sphere, or the like. Alternatively, the first type of abrasive particle 116 can be randomly shaped. Alternatively, the first type of abrasive particle 116 can be irregularly shaped. In an embodiment, the first type of abrasive particle 116 can be a crushed grain.

In a number of embodiments, the first type of abrasive particles 116 may have an average crystallite size of not greater than 10 μm, not greater than 8 μm, not greater than 5 μm, not greater than 2 μm, not greater than 1 μm, not greater than 0.5 μm, or not greater than 0.2 μm. In a number of embodiments, the first type of abrasive particles 116 may have average crystallite size in a range of about 0.01 μm-about 10 μm, in a range of about 0.01 μm-about 1 μm, or in a range of about 0.005 μm-about 0.2 μm.

In an embodiment, the first type of abrasive particles 116 can have an average particle size, $D50_{T1}$, not greater than 2000 microns, such as not greater than about 1500 microns, not greater than about 1000 microns, not greater than about 750 microns, or not greater than 500 microns. In another embodiment, the first type of abrasive particles 116 can have an average particle size, $D50_{T1}$, may be at least 0.5 microns, at least 1 microns, at least 5 microns, at least 10 microns, at least 25 microns, or at least 45 microns. In another embodiment, the first type of abrasive particles 116 can have an average particle size, $D50_{T1}$, from about 0.5 microns to about 2000 microns, such as about 50 microns to about 1000 microns, about 100 microns to about 500 microns, about 125 microns to about 275 microns. The particle size of the first type of abrasive particles 116 is typically specified to be the longest dimension of the abrasive particle. Generally, there is a range distribution of particle sizes. In some instances, the particle size distribution may be tightly controlled.

In a number of embodiments, the first type of abrasive particles 116 can have a length, $L_{T1}$, a width, $W_{T1}$, and a thickness, Tn. In a number of embodiments, $L_{T1} \geq W_{T1} \geq T_{T1}$. In a number of embodiments, the first type of abrasive particles 116 may have a primary aspect ratio, $\Theta^1_{T1}=[L_{T1}:W_{T1}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the first type of abrasive particles 116 may have a primary aspect ratio, $\Theta^1_{T1}=[L_{T1}:W_{T1}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the first type of abrasive particle may have a secondary aspect ratio, $\Theta^2_{T1}=[W_{T1}:T_{T1}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the first type of abrasive particles 116 may have a secondary aspect ratio, $\Theta^2_{T1}=[W_{T1}:T_{T1}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the first type of abrasive particles 116 may have a tertiary aspect ratio, $\Theta^3_{T1}=[L_{T1}:T_{T1}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the first type of abrasive particles 116 may have a tertiary aspect ratio, $\Theta^3_{T1}=[L_{T1}:T_{T1}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the blend includes at least xx (grain weight) of the first type of abrasive particle 116 overlying the substrate 110. In a number of embodiments, the blend may include at least 1 wt % of the first type of abrasive particle 116 for the total weight of the blend. In a number of embodiments, the blend may include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of the first type of abrasive particle 116 for the total weight of the blend. In a number of embodiments, the blend may include no greater than 95 wt %, no greater than 90 wt %, no greater than 85 wt %, no greater than 80 wt %, no greater than 75 wt %, no greater than 70 wt %, no greater than 65 wt %, no greater than 60 wt %, no greater than 55 wt %, no greater than 50 wt %, no greater than 45 wt %, no greater than 40 wt %, no greater than 35 wt %, no greater than 30 wt %, no greater than 25 wt %, no greater than 20 wt %, no greater than 15 wt %, no greater than 10 wt %, no greater than 5 wt %, or no greater than 1 wt % of the first type of abrasive particle 116 for the total weight of the blend. In a number of embodiments, the blend may include at least 1 wt % and no greater than 95 wt % of the first type of abrasive particle 116 for the total weight of the blend.

In a number of embodiments, the first type of abrasive particle 116 may include an average friability, $F_1$, of not greater than 0.60. In a number of embodiments, the first type of abrasive particle 116 may include an average friability, $F_1$, of at least 0.57. In a number of embodiments, the first type of abrasive particle 116 may include an average friability, $F_1$, of at least 0.57 and not greater than 0.60. In a number of embodiments, the first type of abrasive particle 116 may be uniformly distributed in the second region 112*b*.

In a number of embodiments, the first type of abrasive particle 116 may include a loose pack density, $\eta_1$, of not greater than 1.91 g/cc. In a number of embodiments, the first type of abrasive particle 116 may include a loose pack density, $\eta_1$, of at least 1.71 g/cc. In a number of embodiments, the first type of abrasive particle 116 may include a loose pack density, $\eta_1$, of at least 1.71 g/cc and not greater than 1.91 g/cc.

Second Type of Abrasive Particles

The second type of abrasive particles 118 can include essentially single phase inorganic materials, such as alumina, silicon carbide, silica, ceria, and harder, high performance superabrasive particles such as cubic boron nitride and diamond. Additionally, the second type of abrasive particles 118 can include composite particulate materials. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures.

The second type of abrasive particles 118 can be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the second type of abrasive particles 118 can be selected from a group consisting of silica, alumina (including amorphous alumina or any type of fused alumina), zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense second type of abrasive particles 118 comprised principally of alpha-alumina. In a number of embodiments, the second type of abrasive particles 118 can include a polycrystalline material. In a number of embodiments, the second type of abrasive particles 118 can consist essentially of alumina.

The second type of abrasive particles 118 can also have a particular shape. An example of such a shape includes a rod, a triangle, a pyramid, a cone, a solid sphere, a hollow sphere, or the like. Alternatively, the second type of abrasive particles 118 can be randomly shaped. Alternatively, the second type of abrasive particles 118 can be irregularly shaped. In an embodiment, the second type of abrasive particles 118 may be a crushed grain.

In a number of embodiments, the second type of abrasive particles 118 may have an average crystallite size of not greater than 10 μm, not greater than 8 μm, not greater than 5 μm, not greater than 2 μm, not greater than 1 μm, not greater than 0.5 μm, or not greater than 0.2 μm. In a number of embodiments, the second type of abrasive particles 118 may have average crystallite size in a range of about 0.01 μm-about 10 μm, in a range of about 0.01 μm-about 1 μm, or in a range of about 0.005 μm-about 0.2 μm.

In an embodiment, the second type of abrasive particles 118 can have an average particle size, $D50_{T2}$, not greater than 2000 microns, such as not greater than about 1500 microns, not greater than about 1000 microns, not greater than about 750 microns, or not greater than 500 microns. In another embodiment, the second type of abrasive particles 118 can have an average particle size, $D50_{T2}$, may be at least 0.1 microns, at least 1 microns, at least 5 microns, at least 10 microns, at least 25 microns, or at least 45 microns. In another embodiment, the second type of abrasive particles 118 can have an average particle size, $D50_{T2}$, from about 0.1 microns to about 2000 microns, such as about 50 microns to about 1000 microns, about 100 microns to about 500 microns, about 125 microns to about 275 microns. The particle size of the second type of abrasive particles 118 is typically specified to be the longest dimension of the abrasive particle. Generally, there is a range distribution of particle sizes. In some instances, the particle size distribution may be tightly controlled.

In a number of embodiments, the second type of abrasive particles 118 can have a length, $L_{T2}$, a width, $W_{T2}$, and a thickness, $T_{T2}$. In a number of embodiments, $L_{T2} \geq W_{T2} \geq T_{T2}$. In a number of embodiments, the second type of abrasive particles 118 may have a primary aspect ratio, $\Theta^1_{T2}=[L_{T2}:W_{T2}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the second type of abrasive particles 118 may have a primary aspect ratio, $\Theta^1_{T2}=[L_{T2}:W_{T2}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the second type of abrasive particle 118 may have a secondary aspect ratio, $\Theta^2_{T2}=[W_{T2}:T_{T2}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the second type of abrasive particles 118 may have a secondary aspect ratio, $\Theta^2_{T2}=[W_{T2}:T_{T2}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the second type of abrasive particles 118 may have a tertiary aspect ratio, $\Theta^3_{T2}=[L_{T2}:T_{T2}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the second type of abrasive particles 118 may have a tertiary aspect ratio, $\Theta^3_{T2}=[L_{T2}:T_{T2}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the blend includes at least xx (grain weight) of the second type of abrasive particles 118 overlying the substrate 110. In a number of embodiments, the blend may include at least 1 wt % of the second type of abrasive particle 118 for the total weight of the blend. In a number of embodiments, the blend may include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of the second type of abrasive particle 118 for the total weight of the blend. In a number of embodiments, the blend may include no greater than 95 wt %, no greater than 90 wt %, no greater than 85 wt %, no greater than 80 wt %, no greater than 75 wt %, no greater than 70 wt %, no greater than 65 wt %, no greater than 60 wt %, no greater than 5 wt %, no greater than 50 wt %, no greater than 45 wt %, no greater than 40 wt %, no greater than 35 wt %, no greater than 30 wt %, no greater than 25 wt %, no greater than 20 wt %, no greater than 15 wt %, no greater than 10 wt %, no greater than 5 wt %, or no greater than 1 wt % of the second type of abrasive particle 118 for the total weight of the blend. In a number of embodiments, the blend may include at least 1 wt % and no greater than 95 wt % of the second type of abrasive particle 118 for the total weight of the blend.

In a number of embodiments, the second type of abrasive particle 118 may include an average friability, $F_2$, of not greater than 0.69. In a number of embodiments, the second type of abrasive particle 118 may include an average friability, $F_2$, of at least 0.64. In a number of embodiments, the second type of abrasive particle 118 may include an average friability, $F_1$, of at least 0.64 and not greater than 0.69. In a number of embodiments, the second type of abrasive particle 118 may be uniformly distributed in the second region 112*b*.

In a number of embodiments, the second type of abrasive particle 118 may include a loose pack density, $\eta_2$, of not greater than 1.8 g/cc. In a number of embodiments, the second type of abrasive particle 118 may include a loose pack density, $\eta_2$, of at least 1.64 g/cc. In a number of embodiments, the second type of abrasive particle 118 may include a loose pack density, $\eta_2$, of at least 1.64 g/cc and not greater than 1.8 g/cc.

Additive Particles

In a number of embodiments, the additive particle 119 can include a third type of abrasive particle or a filler. The additive particles 119 can include essentially single phase inorganic materials, such as alumina, silicon carbide, silica, ceria, and harder, high performance superabrasive particles such as cubic boron nitride and diamond. Additionally, the additive particles 119 can include composite particulate materials. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures.

The additive particles 119 can be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the additive particles 119 can be selected from a group consisting of silica, alumina (including amorphous alumina or any type of fused alumina), zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense additive particles 119 comprised principally of alpha-alumina. In a number of embodiments, the additive particles 119 can include a polycrystalline material. In a number of embodiments, the additive particles 119 can consist essentially of alumina. In a number of embodiments, the additive particles 119 can include brown fused $Al_2O_3$.

In a particular embodiment, the additive particles 119 can include an oxide, such as alumina, and particularly, brown alumina. For at least one embodiment, the additive particles 119 can consist essentially of brown alumina. According to an aspect, brown alumina can include alumina ($Al_2O_3$) within a range of 88 wt % to 99 wt % for a total weight of brown alumina. Additionally, brown alumina can include an oxide other than alumina. For example, brown alumina can include silica ($SiO_2$) within a range of 0.05 wt % to 5 wt % for a total weight of brown alumina, iron oxide ($Fe_2O_3$) within a range of 0.03 wt % to 4 wt % for a total weight of brown alumina, titanium oxide ($TiO_2$) within a range of 0.1 wt % to 3 wt % for a total weight of brown alumina, or any combination thereof.

In a particular embodiment, the additive particles 119 can include brown fused alumina. More particularly, the additive particles 119 can consist essentially of brown fused alumina. In one embodiment, the brown fused alumina can include $Al_2O_3$ within a range of 92 wt % to 98 wt % for a total weight of the brown fused alumina, $Fe_2O_3$ within a range of 0.3 wt % to 0.7 wt % for a total weight of the brown fused alumina, CaO within a range of 0.3 wt % to 0.8 wt % for a total weight of the brown fused alumina, $TiO_2$ within a range of 1.1 wt % to 3.2 wt % for a total weight of the brown fused alumina, $SiO_2$ within a range of 0.3 wt % to 1.7 wt % for a total weight of the brown fused alumina, MgO within a range of 0.1 wt % to 0.4 wt % for a total weight of the brown fused alumina, or any combination thereof.

The additive particles 119 can also have a particular shape. An example of such a shape includes a rod, a triangle, a pyramid, a cone, a solid sphere, a hollow sphere, or the like. Alternatively, the additive particles 119 can be randomly shaped. Alternatively, the additive particles 119 can be irregularly shaped. In an embodiment, the additive particles 119 may be a crushed grain.

In a number of embodiments, the additive particles 119 may have an average crystallite size of not greater than 10 μm, not greater than 8 μm, not greater than 5 μm, not greater than 2 μm, not greater than 1 μm, not greater than 0.5 μm, or not greater than 0.2 μm. In a number of embodiments, the additive particles 119 may have average crystallite size in a range of about 0.01 μm-about 10 μm, in a range of about 0.01 μm-about 1 μm, or in a range of about 0.005 μm-about 0.2 μm.

As used herein, the average crystallite size (i.e., average grain size) can be measured based on the uncorrected intercept method using scanning electron microscope (SEM) photomicrographs. Samples of abrasive grains may be prepared by making a bakelite mount in epoxy resin then polished with diamond polishing slurry using a Struers Tegramin 30 polishing unit. After polishing the epoxy may be heated on a hot plate, the polished surface may then be thermally etched for 5 minutes at 150° C. below sintering temperature. Individual grains (5-10 grits) may be mounted on the SEM mount then gold coated for SEM preparation. SEM photomicrographs of three individual abrasive particles are taken at approximately 50,000× magnification, then the uncorrected crystallite size may be calculated using the following steps: 1) draw diagonal lines from one corner to the opposite corner of the crystal structure view, excluding black data band at bottom of photo 2) measure the length of the diagonal lines as L1 and L2 to the nearest 0.1 centimeters; 3) count the number of grain boundaries intersected by each of the diagonal lines, (i.e., grain boundary intersections I1 and I2) and record this number for each of the diagonal lines, 4) determine a calculated bar number by measuring the length (in centimeters) of the micron bar (i.e., "bar length") at the bottom of each photomicrograph or view screen, and divide the bar length (in microns) by the bar length (in centimeters); 5) add the total centimeters of the diagonal lines drawn on photomicrograph (L1+L2) to obtain a sum of the diagonal lengths; 6) add the numbers of grain boundary intersections for both diagonal lines (I1+I2) to obtain a sum of the grain boundary intersections; 7) divide the sum of the diagonal lengths (L1+L2) in centimeters by the sum of grain boundary intersections (I1+I2) and multiply this number by the calculated bar number. This process may be completed at least three different times for three different, randomly selected samples to obtain an average crystallite size.

In an embodiment, the additive particles 119 can have an average particle size, $D50_{AP}$, not greater than 500 microns, such as not greater than about 400 microns, not greater than about 300 microns, not greater than about 200 microns, not greater than 100 microns, not greater than 50 microns, not greater than 25 microns, or not greater than 10 microns. In another embodiment, the additive particles 119 can have an average particle size, $D50_{AP}$, may be at least 5 microns, at least 10 microns, at least 25 microns, at least 50 microns, at least 100 microns, at least 200 microns, at least 300 microns, at least 400 microns, or at least 500 microns. In another embodiment, the additive particles 119 can have an average particle size, $D50_{AP}$, from about 5 microns to about 1000 microns, such as about 50 microns to about 1000 microns, about 100 microns to about 500 microns, about 125 microns to about 275 microns. The particle size of the additive particles 119 is typically specified to be the longest dimension of the abrasive particle. Generally, there is a range distribution of particle sizes. In some instances, the particle size distribution may be tightly controlled.

In a number of embodiments, the additive particles 119 can have a length, $L_{AP}$, a width, $W_{AP}$, and a thickness, $T_{AP}$. In a number of embodiments, $L_{AP} \geq W_{AP} \geq T_{AP}$. In a number of embodiments, the additive particles 119 may have a primary aspect ratio, $\Theta^1_{AP}=[L_{AP}:W_{AP}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the additive particles 119 may have a primary aspect ratio, $\Theta^1_{AP}=[L_{AP}:W_{AP}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the first type of abrasive particle may have a secondary aspect ratio, $\Theta^2_{AP}=[W_{AP}:T_{AP}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the additive particles 119 may have a secondary aspect ratio, $\Theta^2_{AP}=[W_{AP}:T_{AP}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the additive particles 119 may have a tertiary aspect ratio, $\Theta^3_{AP}=[L_{AP}:T_{AP}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1. In a number of embodiments, the additive particles 119 may have a tertiary aspect ratio, $\Theta^3_{AP}=[L_{AP}:T_{AP}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

In a number of embodiments, the blend includes at least xx (grain weight) of the additive particles 119 overlying the substrate 110. In a number of embodiments, the blend may include at least 1 wt % of the second type of abrasive particle 118 for the total weight of the blend. In a number of embodiments, the blend may include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of the second type of abrasive particle 118 for the total weight of the blend. In a number of embodiments, the blend may include no greater than 95 wt %, no greater than 90 wt %, no greater than 85 wt %, no greater than 80 wt %, no greater than 75 wt %, no greater than 70 wt %, no greater than 65 wt %, no greater than 60 wt %, no greater than 55 wt %, no greater than 50 wt %, no greater than 45 wt %, no greater than 40 wt %, no greater than 35 wt %, no greater than 30 wt %, no greater than 25 wt %, no greater than 20 wt %, no greater than 15 wt %, no greater than 10 wt %, no greater than 5 wt %, or no greater than 1 wt % of the second type of abrasive particle 118 for the total weight of the blend. In a number of embodiments, the blend may include at least 1 wt % and no greater than 95 wt % of the second type of abrasive particle 118 for the total weight of the blend.

In a number of embodiments, the additive particles 119 can include aluminum oxide abrasive particles produced by a fusion process (commonly known as "ALO" abrasive particles or "fused aluminum oxide" abrasive particles). ALO abrasive particles include alumina zirconia fusion abrasive particles, Brown friable aluminum oxide abrasive particles, semi-friable aluminum oxide abrasive particles, and white friable aluminum oxide abrasive particles. ALO abrasive particles can be heat treated to alter the physical and abrasive performance properties of the abrasive particles. Such heated treated ALO abrasive particles are commonly referred to as "heat treated" versions of the particles (e.g., heat treated brown friable aluminum oxide abrasive particles).

In a number of embodiments, the third type of abrasive particle 119 may include a loose pack density, $\eta_3$, of not greater than 2 g/cc. In a number of embodiments, the third type of abrasive particle 119 may include a loose pack density, $\eta_3$, of at least 1.5 g/cc. In a number of embodiments, the third type of abrasive particle 119 may include a loose pack density, $\eta_3$, of at least 1.5 g/cc and not greater than 2 g/cc.

Figure 15:
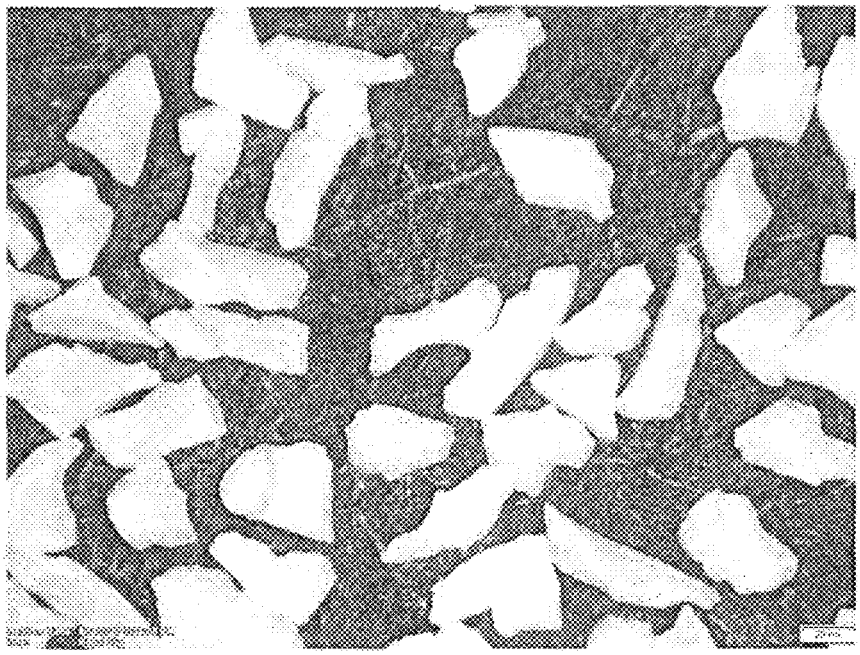
FIG. 15 is a magnified image of a second type of abrasive particle used in an inventive embodiment.
Figure 16:
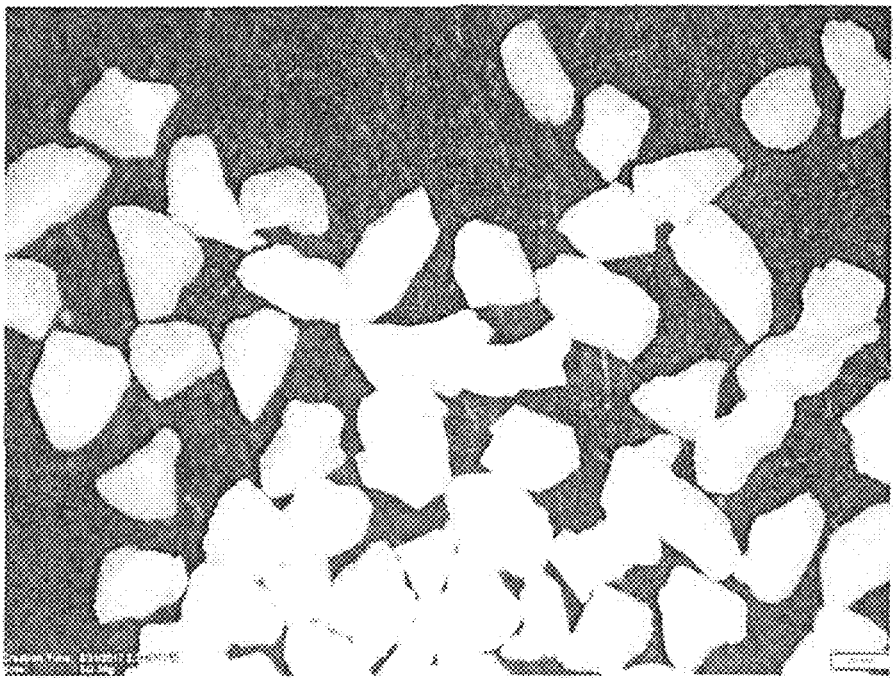
FIG. 16 is a magnified image of a second type of abrasive particle used in an inventive embodiment.

Loose pack density is typically reported as a range of values. It should be noted that unless the loose pack density of two different particles have exactly the same endpoints in the range of loose pack density values, the particles will not have the same shape. For example, in one particular embodiment, the range of loose pack density range of the first type of abrasive particle is 1.71 to 1.91 g/cm$^3$ and the loose pack density range of second type of abrasive particle is 1.64 to 1.8 g/cm$^3$. The loose pack density ranges overlap, however, the particles are different in shape, as illustrated in FIGS. 15 and 16.

As described previously, the abrasive layer 112 may include the first type of abrasive particles 116, the second type of abrasive particles 118, and optionally the additive particles 119 disposed on, or dispersed in, the polymeric binder layer 114 composition. In a number of embodiments, the first type of abrasive particles 116, the second type of abrasive particles 118, and optionally the additive particles 119 may form a blend of abrasive particles. In a number of embodiments, the blend of abrasive particles may include a loose pack density, $\eta_{blend}$, of not greater than 2 g/cc, such as not greater than 1.9 g/cc, not greater than 1.87 g/cc, not greater than 1.85 g/cc, or not greater than 1.8 g/cc. In a number of embodiments, the blend of abrasive particles may include a loose pack density, $\eta_3$, of at least 1.5 g/cc, such as at least 1.6 g/cc, at least 1.7 g/cc, or at least 1.75 g/cc. In a number of embodiments, the blend of abrasive particles may include a loose pack density, $\eta_{blend}$, of at least 1.5 g/cc and not greater than 2 g/cc, such as at least 1.7 g/cc and not greater than 1.85 g/cc.

Additional Particle Types

In an embodiment, at least one of the first type of abrasive particles 116, second type of abrasive particles 118, or additive particles 119 can include an aluminum oxide fusion process abrasive particle. In a particular embodiment, at least one of the first type of abrasive particles 116, second type of abrasive particles 118, or additive particles 119 comprises brown aluminum oxide abrasive particles, semi-friable aluminum oxide abrasive particles, white aluminum oxide abrasive particles, heat treated versions thereof, or combinations thereof.

In an embodiment, at least one of the first type of abrasive particles 116, second type of abrasive particles 118, or additive particles 119 can include ceramic abrasive particles, such as ceramic aluminum oxide abrasive particles. Ceramic aluminum oxide abrasive particles (also called sol-gel aluminum oxide) may be produced by sol-gel formation processes. Sol-gel processes include seeded gel alumina formation processes. Seeded gel alumina abrasive particles are ceramic aluminum oxide particles manufactured by a sintering process and have a very fine microstructure. In a number of embodiments, at least one of the first type of abrasive particles 116, second type of abrasive particles 118, or additive particles 119 may be composed of sub-micron size sub-particles (micro to nano sized primary particles of alumina) that under grinding force may be separated off from the larger secondary abrasive particle. Seeded-gel abrasive particles tend to stay sharper than conventional abrasive particles, which can dull as flats are worn on the working points of the abrasive grits. Ceramic aluminum oxide particles include ceramic aluminum oxide shaped abrasive particles, ceramic aluminum oxide crushed abrasive particles, and ceramic aluminum oxide exploded particles.

Ceramic abrasive particles can be doped ceramic abrasive particles or undoped (i.e., not doped) ceramic abrasive particles. In an embodiment, the ceramic abrasive particles may be undoped ceramic abrasive particles. In another embodiment, the ceramic abrasive particles may be doped abrasive particles. Doped abrasive particles can be doped in vary amounts. In an embodiment, the dopant can comprise 0.1 wt % to 3.0 wt % of the ceramic abrasive particles, such as from 0.5 wt % to 1.5 wt % of a dopant. Dopant compounds can comprise various metal oxides, such as magnesium oxide (MgO) or zirconium dioxide ($ZrO_2$). In an embodiment, the dopant comprises MgO, such as 0.5 wt % to 1.5 wt % MgO. In an embodiment, the dopant comprises $ZrO_2$, such as 0.5 wt % to 1.5 wt % $ZrO_2$.

Number of Pluralities of Abrasive Particles

The total number of pluralities of abrasive grains (types of abrasive grains) in abrasive blends (including the first type of abrasive particles 116, second type of abrasive particles 118, and/or additive particles 119) of the present disclosure is not particularly limited, and can include up to "n" pluralities of abrasive grains. For example, embodiments of the present disclosure include abrasive blends having at least two pluralities of abrasive grains, such as at least three pluralities of abrasive grains, at least four pluralities of abrasive grains, at least five pluralities of abrasive grains, at least six pluralities of abrasive grains, at least seven pluralities of abrasive grains or . . . at least "n" pluralities of abrasive grains.

In a specific embodiment, the abrasive particles may be a blend of abrasive particles, such as a blend of ceramic aluminum oxide abrasive particles and fusion process aluminum oxide abrasive particles. In a particular embodiment, the abrasive particles comprise a blend of exploded ceramic aluminum oxide abrasive particles and semi-friable aluminum oxide aluminum oxide abrasive particles.

Ratios

Abrasive blend embodiments of the present disclosure may also be defined by various ratios or ratio relationships of the first type of abrasive particles 116, second type of abrasive particles 118, and/or additive particles 119 within the blend. In particular, the ratios of particles for abrasive blends described herein, whether comprising two, three, four, five, six, seven, or . . . "n" pluralities of particles is not particularly limited. For example, for abrasive blends having two pluralities of particles, the ratio of the amount of the first type of abrasive particles 116 to the second type of abrasive particles 118 can be written as: x:y, where x represents the amount of the first type of abrasive particles 116 in the blend; y represents the amount of the second type of abrasive particles 118 in the blend; and x and y are defined within a set of any positive integer value greater than zero. For abrasive blends having three pluralities of particles, the ratio of the amount of the first type of abrasive particles 116 to the second type of abrasive particles 118, and the additive particles 119 can be written as: x:y:z, where x represents the amount of the first type of abrasive particles **6*n* the blend; y represents the amount of the second type of abrasive particles 118 in the blend; z represents the amount of the additive particles 119** in the blend; and x, y and z are defined within a set of any positive integer value greater than zero. The same can be repeated for up to "n" plurality of particles.

In abrasive blend ratios of the present disclosure, x, y, z . . . n, as described above, can be any one of a set of positive integer values greater than zero. In certain embodiments, x, y, z . . . n can all be different values. In other embodiments, any one and up to all x, y and z . . . n can be identical values.

For example, in embodiments where the abrasive blend comprises two pluralities of particles, such as the first type of abrasive particles 116 and the second type of abrasive particles 118, the abrasive blend may comprise a grain ratio between the first type of abrasive particles 116 and the second type of abrasive particles 118 ranging from 1:10, such as from 1:9, from 1:8, from 1:7, from 1:6, from 1:5, from 1:4, from 1:3, 1:2; or from 1:1, and vice versa with respect to a grain ratio between the second type of abrasive particles 118 and the first type of abrasive particles 116 for each of the aforementioned ratio values.

In certain embodiments where the abrasive blend comprises two pluralities of particles, the abrasive blend may comprise a grain ratio between the first type of abrasive particles 116 and the second type of abrasive particles 118 of 2:3, or 2:5, or 2:7, or 2:9; and vice versa with respect to a grain ratio between the second type of abrasive particles 118 and the first type of abrasive particles 116 for each of the aforementioned ratio values.

In embodiments where the abrasive blend comprises three pluralities of particles, the abrasive blend may comprise a particle ratio between the first type of abrasive particles 116 and the second type of abrasive particles 118 ranging from 1:10, such as from 1:9, from 1:8, from 1:7, from 1:6, from 1:5, from 1:4, from 1:3, 1:2; or from 1:1 and vice versa with respect to a grain ratio between the second type of abrasive particles 118 and the first type of abrasive particles 116 for each of the aforementioned ratio values.

In certain embodiments where the abrasive blend comprises three pluralities of abrasive grains, the abrasive blend may comprise a grain ratio between the first type of abrasive particles 116 and the second type of abrasive particles 118 of 2:3, or 2:5, or 2:7, or 2:9; and vice versa with respect to a grain ratio between the second type of abrasive particles 118 and the first type of abrasive particles 1186 for each of the aforementioned ratio values.

In certain embodiments where the abrasive blend comprises three pluralities of abrasive grains, the abrasive blend may comprise a grain ratio between the first type of abrasive particles 116, the second type of abrasive particles 118, and the additive particles 119 of from 1:5:10, and all values between, such as from 1:5:9, from 1:5:8, from 1:5:7, from 1:2:10, from 1:3:10, from 1:4:10, from 2:5:10 from 2:5:9, from 2:4:8, from 2:4:7, from 2:5:7, from 3:5:10, from 3:5:9, from 3:5:7, from 3:5:7, from 3:5:5, from 1:3:3, from 1:2:3, from 1:1:10, from 1:1:5, from 1:1:2, from 1:1:1, or from 2:2:5.

In embodiments where the abrasive blend comprises two or more pluralities of abrasive grains, the first type of abrasive particles 118 (this may apply for two, three, four or five plurality of abrasive grain blends) may be present in an amount that is at least twice the amount of the second type of abrasive particles 118 in the abrasive grain blend. Alternatively, in the first type of abrasive particles 116 and the second type of abrasive particles 118 may be present in equal amounts in the abrasive blend.

In embodiments where the abrasive blend comprises three or more pluralities of abrasive grains, the second type of abrasive particles 118 may be present in an amount that may be at least twice the amount of the additive particles 119 in the abrasive blend. Alternatively, the first type of abrasive particles 116, the second type of abrasive particles 118 and the additive particles 119 may be present in equal amounts in the abrasive blend.

In embodiments where the abrasive blend comprises three or more pluralities of abrasive grains, the additive particles 119 may be present in an amount that may be at least twice the amount of the first type of abrasive particles 116.

In abrasive blend embodiments, the second type of abrasive particles 118 may be present in an amount of no greater than ten times the amount of the first type of abrasive particles 116, and vice versa between the first type of abrasive particles 116 and the second type of abrasive particles 118. Moreover, in embodiments where the abrasive blend comprises three or more pluralities of abrasive grains, the first type of abrasive particles 116 is present in an amount of no greater than ten times the amount of the additive particles 119, and vice versa between the first type of abrasive particles 116 and the additive particles 119.

It will be appreciated that the grain ratios (whether with respect to the first type of abrasive particles 116 and the second type of abrasive particles 118; the second type of abrasive particles 118 with respect to the additive particles 119; the first type of abrasive particles 116 with respect to the additive particles 119; the first type of abrasive particles 116 with respect to the second type of abrasive particles 118 and additive particles 119; or the first type of abrasive particles 116 with respect to the second type of abrasive particles 118 and a fourth plurality of abrasive particles, and the like) is not particularly limiting and the above described ratios and amounts are intended to encompass all vice versa scenarios, and all range amounts between the ratios and/or amounts described above; and may also be applied to different combinations of first, second, third, fourth and/or fifth plurality of abrasive grains, and any combinations or multiple ratios thereof, not specifically listed herein.

It will be appreciated that the above-described grain ratios and amounts of grains with respect to other grains in a grain blend are not intended to be limiting, and that the above-described illustrative ratios.

In a particular embodiment, the additive particles 119 can include ceramic aluminum oxide abrasive particles, which can be unexploded ceramic aluminum oxide particles or exploded ceramic aluminum oxide abrasive particles or a combination thereof. The ceramic aluminum oxide particles can include a dopant. In a specific embodiment, the additive particles 119 can include high performance exploded ceramic aluminum oxide abrasive particles. In a particular aspect, the abrasive particles may not be doped. In another aspect, the abrasive particles may be doped with an amount of MgO, which can range from 0.1 wt % to 3 wt %, such as 0.5 wt % to 1.5 wt %, such as about 1 wt %. In one aspect, exploded ceramic abrasive particles made using an explosion process that gives the particles extremely sharp edges that remain sharp relatively longer than comparable abrasive particles.

The additive particles 119 can include semi-friable aluminum oxide particles, such as a heat treated semi-friable brown aluminum oxide particles. In a particular aspect, the particles can be crushed abrasive particles formed using a crushing process. In particular, the particles can be formed using a roller crushing process, which tends to produce a higher aspect ratio for the abrasive particles, as well as beneficial fracture properties.

In a particular aspect, the additive particles 119 may be present in the mixture of the first type of abrasive particles 116 and the second type of abrasive particles 118 in an amount greater than or equal to 25 wt %. In another aspect, the additive particles 119 may be present in an amount greater than or equal to 30 wt %, such as greater than or equal to 35 wt %, greater than or equal to 40 wt %, greater than or equal to 45 wt %, or greater than or equal to 50 wt %. In yet another aspect, the additive particles 119 may be present in the mixture in an amount less than or equal to 75 wt %. In particular, the additive particles 119 may be present in an amount less than or equal to 70 wt %, such as less than or equal to 65 wt %, less than or equal to 60 wt %, less than or equal to 55% wt, or less than or equal to 50 wt %.

In another aspect, the additive particles 119 may be present in the mixture of the first type of abrasive particles 116 and the second type of abrasive particles 118 in an amount less than or equal to 75 wt %. In another aspect, the additive particles 119 may be present in an amount less than or equal to 70 wt %, such as less than or equal to 65 wt %, less than or equal to 60 wt %, less than or equal to 55 wt %, or less than or equal to 50 wt % In yet another aspect, additive particles 119 may be present in the mixture in an amount greater than or equal to 25 wt % In particular, the additive particles 119 may be present in an amount greater than or equal to 30 wt %, such as greater than or equal to 35 wt %, greater than or equal to 40 wt %, greater than or equal to 45% wt, or greater than or equal to 50 wt %.

In a particular aspect, the first type of abrasive particles 116 and the second type of abrasive particles 118 may be present in the mixture of the first type of abrasive particles 116 and the second type of abrasive particles at a ratio of 1:3. In another particular aspect, the first type of abrasive particles 116 and the second type of abrasive particles 118 may be present in the mixture of the first type of abrasive particles 116 and the second type of abrasive particles at a ratio of 1:1. In yet another particular aspect, the first type of abrasive particles 116 and the second type of abrasive particles 118 may be present in the mixture of the first type of abrasive particles 116 and the second type of abrasive particles 118 at a ratio of 3:1.

In a number of embodiments, the first type of abrasive particles 116 and the additive particles 119 may form a first particle size ratio, [$D50_{T1}$:$D50_{AP}$]. In a number of embodiments, the first particle size ratio, [$D50_{T1}$:$D50_{AP}$] may be not greater than 100:1, not greater than 90:1, not greater than 80:1, not greater than 70:1, not greater than 60:1, not greater than 50:1, not greater than 40:1, not greater than 30:1, not greater than 20:1, not greater than 10:1, not greater than 5:1, not greater than 4:1, not greater than 3:1, not greater than 2:1, or not greater than 1.1:1. In a number of embodiments, the first particle size ratio, [$D50_{T1}$:$D50_{AP}$] may be at least 1:1.1, at least 2:1, at least 3:1, at least 4:1, at least 5:1, at least 10:1, at least 20:1, at least 30:1, at least 40:1, at least 50:1, at least 60:1, at least 70:1, at least 80:1, at least 90:1, at least 100:1. In a number of embodiments, the first particle size ratio, [$D50_{T1}$:$D50_{AP}$] may be within the range of at least 1.1:1 but not greater than 100:1.

In a number of embodiments, the second type of abrasive particles 118 and the additive particles 119 may form a second particle size ratio, [$D50_{T2}$:$D50_{AP}$]. In a number of embodiments, the second particle size ratio, [$D50_{T2}$:$D50_{AP}$] may be not greater than 100:1, not greater than 90:1, not greater than 80:1, not greater than 70:1, not greater than 60:1, not greater than 50:1, not greater than 40:1, not greater than 30:1, not greater than 20:1, not greater than 10:1, not greater than 5:1, not greater than 4:1, not greater than 3:1, not greater than 2:1, or not greater than 1.1:1. In a number of embodiments, the second particle size ratio, [$D50_{T2}$:$D50_{AP}$] may be at least 1:1.1, at least 2:1, at least 3:1, at least 4:1, at least 5:1, at least 10:1, at least 20:1, at least 30:1, at least 40:1, at least 50:1, at least 60:1, at least 70:1, at least 80:1, at least 90:1, at least 100:1. In a number of embodiments, the first particle size ratio, [$D50_{T2}$:$D50_{AP}$] may be within the range of at least 1.1:1 but not greater than 100:1.

In a number of embodiments, the abrasive layer 112 includes a blend of abrasive particles including a first type of abrasive particle 116, and a second type of abrasive particle 118 may form an average particle size difference, $\Delta D50_1=|D50_{T1}-D50_{T2}|$ within a range of at least 0.05, at least 0.1 μm, at least 0.5 μm, at least 1 μm, at least 5 μm, at least 10 μm, o at least 25 μm, at least 50 μm, at least 100 μm, at least 250 μm, at least 500 μm, at least 750 μm, or at least 1000 μm. In a number of embodiments, the abrasive layer 112 includes a blend of abrasive particles including a first type of abrasive particle 116, and a second type of abrasive particle 118 may form an average particle size difference, $\Delta D50_1=|D50_{T1}-D50_{T2}|$ within a range of no greater than 1000 μm, no greater than 750 μm, no greater than 500 μm, no greater than 250 μm, no greater than 100 μm, no greater than 50 μm, or no greater than 25 μm. In a number of embodiments, the abrasive layer 112 includes a blend of abrasive particles including a first type of abrasive particle 116, and a second type of abrasive particle 118 may form an average particle size difference, $\Delta D50_1=|D50_{T1}-D50_{T2}|$ within the range of 0.1 μm to 600 μm.

In a number of embodiments, the abrasive layer 112 includes a blend of abrasive particles including a first type of abrasive particle 116, and a third type of abrasive particle 119 may form an average particle size difference, $\Delta D50_2=|D50_{T1}-D50_{T3}|$ within a range of at least 0.05, at least 0.1 μm, at least 0.5 μm, at least 1 μm, at least 5 μm, at least 10 μm, o at least 25 μm, at least 50 μm, at least 100 μm, at least 250 μm, at least 500 μm, at least 750 μm, at least 1000 μm, or at least 1200 μm. In a number of embodiments, the abrasive layer 112 includes a blend of abrasive particles including a first type of abrasive particle 116, and a third type of abrasive particle 119 may form an average particle size difference, $\Delta D50_2=|D50_{T1}-D50_{T3}|$ within a range of no greater than 1200 μm, no greater than 1000 μm, no greater than 750 μm, no greater than 500 μm, no greater than 250 μm, no greater than 100 μm, no greater than 50 μm, or no greater than 25 μm. In a number of embodiments, the abrasive layer 112 includes a blend of abrasive particles including a first type of abrasive particle 116, and a third type of abrasive particle 119 may form an average particle size difference, $\Delta D50_2=|D50_{T1}-D50_{T3}|$ within the range of 0.1 μm to 1200 μm.

In a number of embodiments, the abrasive layer 112 includes a blend of abrasive particles including a second type of abrasive particle 118, and a third type of abrasive particle 119 may form an average particle size difference, $\Delta D50_3=|D50_{T2}-D50_{T3}|$ within a range of at least 0.05, at least 0.1 μm, at least 0.5 μm, at least 1 μm, at least 5 μm, at least 10 μm, o at least 25 μm, at least 50 μm, at least 100 μm, at least 250 μm, at least 500 μm, at least 750 μm, at least 1000 μm, or at least 1200 μm. In a number of embodiments, the abrasive layer 112 includes a blend of abrasive particles including a second type of abrasive particle 118, and a third type of abrasive particle 119 may form an average particle size difference, $\Delta D50_3=|D50_{T2}-D50_{T3}|$ within a range of no greater than 1200 μm, no greater than 1000 μm, no greater than 750 μm, no greater than 500 μm, no greater than 250 μm, no greater than 100 μm, no greater than 50 μm, or no greater than 25 μm. In a number of embodiments, the abrasive layer 112 includes a blend of abrasive particles including a second type of abrasive particle 118, and a third type of abrasive particle 119 may form an average particle size difference, $\Delta D50_3=|D50_{T2}-D50_{T3}|$ within the range of 0.1 μm to 1200 μm.

In a number of embodiments, a difference in the average length of the first type of abrasive particle 116 $L_{T1}$ and the second type of abrasive particle 118 $L_{T2}$ in a % range of not greater than 50%, not greater than 40%, not great than 30%, not greater than 20%, not greater than 18%, not greater than 15%, not greater than 10%, not greater than 5%, not greater than 2%, or not greater than 1%. In a number of embodiments, a difference in the average length of the first type of abrasive particle 116 $L_{T1}$ and the second type of abrasive particle 118 $L_{T2}$ in a % range of not less than 0.05%, not less than 0.1%, not less than 0.5%, not less than 1%, not less than 2%, not less than 5%, not less than 10%, not less than 15%, not less than 18%, not less than 20%, not less than 30%, not less than 40%, or not less than 45%.

In a number of embodiments, a difference in the average width of the first type of abrasive particle 116 $W_{T1}$ and the second type of abrasive particle 118 $W_{T2}$ in a % range of not greater than 50%, not greater than 40%, not great than 30%, not greater than 20%, not greater than 18%, not greater than 15%, not greater than 10%, not greater than 5%, not greater than 2%, or not greater than 1%. In a number of embodiments, a difference in the average width of the first type of abrasive particle 116 $W_{T1}$ and the second type of abrasive particle 118 $W_{T2}$ in a % range of not less than 0.05%, not less than 0.1%, not less than 0.5%, not less than 1%, not less than 2%, not less than 5%, not less than 10%, not less than 15%, not less than 18%, not less than 20%, not less than 30%, not less than 40%, or not less than 45%.

In a number of embodiments, a difference in the average thickness of the first type of abrasive particle 116 $T_{T1}$ and the second type of abrasive particle 118 $T_{T2}$ in a % range of not greater than 50%, not greater than 40%, not great than 30%, not greater than 20%, not greater than 18%, not greater than 15%, not greater than 10%, not greater than 5%, not greater than 2%, or not greater than 1%. In a number of embodiments, a difference in the average thickness of the first type of abrasive particle 116 $T_{T1}$ and the second type of abrasive particle 118 $T_{T2}$ in a % range of not less than 0.05%, not less than 0.1%, not less than 0.5%, not less than 1%, not less than 2%, not less than 5%, not less than 10%, not less than 15%, not less than 18%, not less than 20%, not less than 30%, not less than 40%, or not less than 45%.

Binder Layer

In a particular aspect, the binder layer 114 (commonly known as the make coat) can be formed of a single polymer or a blend of polymers. The binder composition can be formed from an epoxy composition, acrylic composition, a phenolic composition, a polyurethane composition, a urea formaldehyde composition, a polysiloxane composition, or combinations thereof. In addition, the binder composition can include active filler particles, additives, or a combination thereof, as described herein.

The binder composition generally includes a polymer matrix, which binds abrasive particles to the backing or to a compliant coat, if such a compliant coat is present. Typically, the binder composition may be formed of cured binder formulation. In an embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents may typically be curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

In an embodiment, the make coat comprises no filler or abrasive particles 119. In an embodiment, the make coat comprises a urea formaldehyde composition and no filler particles. In another embodiment, the make coat comprises filler particles. In a specific embodiment, the make coat comprises a urea formaldehyde composition and filler particles. In another specific embodiment, the make coat comprises a urea formaldehyde composition, filler particles, and an additive. In a particular embodiment, the make coat comprises about 30 to 75 wt % of a urea formaldehyde composition, about 10 wt % to 45 wt % of filler particles.

In a particular aspect, the binder layer 114 can include: approximately 55-75 wt % of urea formaldehyde resin and approximately 20-35 wt % of calcium sulfate solid filler Size Coat Layer As described above, the abrasive article 100 can comprise a size coat layer 120 disposed on the abrasive layer 112. The size coat layer 120 can be the same as or different from the polymer layer 114 of the abrasive layer 112. The size coat layer 120 can comprise any conventional compositions known in the art that can be used as a size coat layer 120. The size coat layer 120 can include one or more additives.

In a specific embodiment, the size coat layer 120 can include no active filler particles. In another embodiment, the size coat layer 120 can include a urea formaldehyde composition. In another embodiment, the size coat layer 120 can include a urea formaldehyde composition and an additive. In a specific embodiment, the size coat layer 120 can include about 30 to 75 wt % of a urea formaldehyde composition and about 10 wt % to 45 wt % of calcium sulfate.

In a particular aspect, the size coat layer 120 can include: approximately 55-75 wt % of urea formaldehyde resin and approximately 20-35 wt % of calcium sulfate solid filler.

Supersize Coat Layer

As previously described, the abrasive article 100 can comprise a supersize coat layer 122 disposed on the size coat layer 120. The supersize coat layer 122 can be the same as or different from the polymeric binder layer 114 of the abrasive layer 112 and the size coat layer 120 disposed thereon. In another aspect, the supersize coat layer 122 may comprise a stearate, such as a metal stearate, such as zinc stearate.

In a particular aspect, the supersize coat layer 122 can include: approximately 35-55 wt % of a first zinc stearate, approximately 35-55 wt % of a second zinc stearate and approximately 5-30 wt % of an acrylic binder.

Additives

In a particular aspect, the binder layer 114, the size coat layer 120, or the supersize coat layer 122 can include one or more additives. Suitable additives, for example, can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives can be present in any part of the overall system of the coated abrasive product according to embodiments of the present disclosure. Suitable grinding aids can be inorganic based; such as halide salts, for example cryolite, wollastonite, and potassium fluoroborate; or organic based, such as sodium lauryl sulphate, or chlorinated waxes, such as polyvinyl chloride. In an embodiment, the grinding aid can be an environmentally sustainable material.

Tool Attachment Layer

The abrasive article can optionally include a tool attachment layer. In a particular embodiment, the abrasive article 100 includes a tool attachment layer 124 that can be used to removably engage the abrasive article 100 with a tool, such as a random orbit rotary sander. The tool attachment layer 124 can include an adhesive.

In another aspect, the tool attachment layer 124 can include a mechanical fastener. For example, the mechanical fastener can include a hook fastener, a loop fastener, or a combination thereof that may be configured to removably engage with a corresponding mechanical fastener on the tool on which the abrasive article 100 is intended to be disposed during abrasive operations.

EXAMPLES

Example 1. —Abrasive Article Preparation—S1 and S2

Two abrasive belt samples (S1, S2) were prepared according to embodiments herein and as described in greater detail below. A polymeric binder composition ("make coat composition") as described in Table 2 was applied to the backing material. A blend of abrasive grains: Ceramic grain A, Ceramic grain B, and Fusion grain C as described in Table 3 was then applied to the backing in a "split coat." Fusion grain C was applied first to the make coat by gravity coating according to the amount shown in Table 3. A mixture of ceramic abrasive grains (40 wt % ceramic grain A, 60 wt % ceramic grain B) was then projected upward into the make coat by electrostatic deposition coating according to the amount shown in Table 3. The amounts of Ceramic grain A, Ceramic grain B, and Fusion grain C comprising the grain blend are shown in Table 4. Notable features and properties of the individual abrasive grains of the blend Ceramic grain A, Ceramic grain B, and Fusion grain C are described in Table 5. Ceramic grain A the second type of abrasive particle 118 herein and is sold by Saint-Gobain Corporation as HiPAL, Ceramic grain B is the first type of abrasive particle 116 herein and is sold by Saint-Gobain Corporation as SG, and Fusion grain C is the additive particle 119 herein and is sold by Gobain Corporation.

A polymeric size coat composition according to Table 6 was then applied over the make coat and abrasive grains. The size coat was cured and a supersize coat according to Table 7 was then applied over the size coat. The supersize coat was cured and the completed abrasive material was cut and formed into abrasive belts for abrasive testing.

Example 2. —Abrasive Article Preparation—C1, C2, and C3

Comparative abrasive belts (C1, C2, C3) were prepared as described in greater detail below. The manner of preparation was the same as for the inventive sample belts, except as noted herein. For comparative belts C1, C2, and C3, backing materials as described in Table 1 were obtained. A polymeric binder composition ("make coat composition") as described in Table 2 was applied to the backing material. For C1 and C3 a coating of Ceramic grain A was projected upward into the make coat by electrostatic deposition coating according to the amount shown in Table 3. For C2, a blend of Ceramic grain A, and Fusion grain C as described in Table 3 was applied to the backing in a "split coat." Fusion grain C was applied first to the make coat by gravity coating according to the amount shown in Table 3. Ceramic abrasive grains (100 wt % ceramic grain A) was then projected upward into the make coat by electrostatic deposition coating according to the amount shown in Table 3. The amounts of Ceramic grain A and Fusion grain C comprising the grain coats are shown in Table 4. Notable features and properties of the individual abrasive grains Ceramic grain A and Fusion grain C are described in Table 5.

For C1, C2, and C3, a polymeric size coat composition according to Table 6 was then applied over the make coat and abrasive grains. The size coat was cured and a supersize coat according to Table 7 was then applied over the size coat. The supersize coat was cured and the completed abrasive material was cut and formed into abrasive belts for abrasive testing.

TABLE 1

| | Backing Materials | | | | |
|---|---|---|---|---|---|
| | C1 | C2 | C3 | S1 | S2 |
| Backing Material: | Polyester fabric, 1-ply | Polyester fabric, 2-ply | Polyester fabric, 2-ply | Polyester fabric, 1-ply | Polyester fabric, 2-ply |
| Backing weight: | Y weight, 22 lb/ream (326 g/m$^2$) | Y weight, 25.5 lb/ream (377 g/m2) | Y weight, 25.5 lb/ream (377 g/m$^2$) | Y weight, 22 lb/ream (326 g/m$^2$) | Y weight, 25.5 lb/ream (377 g/m$^2$) |
| Backing treatment(s): | Phenolic saturant | Phenolic saturant | Phenolic saturant | Phenolic saturant | Phenolic saturant |
| Back fill: | Acrylic/PVC Latex blend | Acrylic/PVC Latex blend | Acrylic/PVC Latex blend | Acrylic/PVC Latex blend | Acrylic/PVC Latex blend |

TABLE 2

| Polymeric Binder (Make Coat) Compositions | | | | | |
|---|---|---|---|---|---|
| | C1 (wt. %) | C2 (wt. %) | C3 (wt. %) | S1 (wt. %) | S2 (wt. %) |
| Phenolic Resin[1] | 53 | 53 | 53 | 53 | 53 |
| Defoamer[2] | 0.1 | 0.1 | 0.1 | 0.1 | 0.1 |
| Wetting Agent[3] | 0.1 | 0.1 | 0.1 | 0.1 | 0.1 |

TABLE 2-continued

| Polymeric Binder (Make Coat) Compositions | | | | | |
|---|---|---|---|---|---|
| | C1 (wt. %) | C2 (wt. %) | C3 (wt. %) | S1 (wt. %) | S2 (wt. %) |
| Wollastonite | 42 | 42 | 42 | 42 | 42 |
| Water | 4.8 | 4.8 | 4.8 | 4.8 | 4.8 |

Make weight: 22 lbs/ream (326 gsm), wet basis for all samples
[1]Phenolic resole, DeShen (China)
[2]Dee Fo ®, Munzing Chemie GmBH
[3]Witcona 1260, Witco

TABLE 3

| Split Coat Grain Weight Amounts | | | | | | | | | | |
|---|---|---|---|---|---|---|---|---|---|---|
| | C1 | | C2 | | C3 | | S1 | | S2 | |
| Name | lb. per ream | C1 wt. % | lb. per ream | C2 wt. % | lb. per ream | C3 wt. % | lb. per ream | S1 wt. % | lb. per ream | S2 wt. % |
| ESU Grain weight | 55 | 100 | 40 | 75 | 55 | 100 | 39 | 74 | 39 | 74 |
| Gravity Grain weight | — | — | 13.4 | 25 | — | — | 13.4 | 26 | 13.4 | 26 |
| Total | 55 | 100 | 53.4 | 100 | 55 | 100 | 52.4 | 100 | 52.4 | 100 |

TABLE 4

| Abrasive Grain Blend Composition Amounts | | | | | | | | | | |
|---|---|---|---|---|---|---|---|---|---|---|
| | C1 | | C2 | | C3 | | S1 | | S2 | |
| | lb. per ream | C1 wt. % | lb. per ream | C2 wt. % | lb. per ream | C3 wt. % | lb. per ream | S1 wt. % | lb. per ream | S2 wt. % |
| Ceramic D | 55 | 100 | — | — | 55 | 100 | | | | |
| Ceramic A | — | — | 13.4 | 25 | — | — | 15.6 | 30 | 15.6 | 30 |
| Ceramic B | — | — | — | — | — | — | 23.4 | 45 | 23.4 | 45 |
| Fusion C | — | — | 40 | 75 | — | — | 13.4 | 25 | 13.4 | 25 |
| Total | 55 | 100 | 53.4 | 100 | 55 | 100 | 52.4 | 100 | 52.4 | 100 |

TABLE 5

| Abrasive Grain Properties | | | | |
|---|---|---|---|---|
| | Ceramic D | Ceramic A | Ceramic B | Fusion C |
| Type | Seeded Sol-Gel | Seeded Sol-Gel | Seeded Sol-Gel | Fusion |
| Comminution | Exploded | Exploded | Roller Crushed | Crushed |
| Composition | >98 wt % Alpha alumina, 0.75-1.25 wt % MgO Doped | >98 wt % Alpha alumina, 0.75-1.25 wt % MgO Doped | >99.6 wt % Alpha alumina, No MgO dopant | Brown Fused Aluminum Oxide, high purity |
| Avg. Particle Size ($D_{50}$) | P36 grit | P30 grit | P30 grit | P40 grit |
| Avg. Particle Size ($D_{50}$) | 600-650 microns | 600-650 microns | 600-650 microns | 400-425 microns |
| Avg. Crystal Size | 0.12-0.19 microns | 0.12-0.19 microns | 0.13-0.20 microns | |
| Average Friability (%) | 0.64-0.69 | 0.64-0.69 | 0.57-0.60 | |
| Density ($g/cm^3$) | 3.85-3.94 | 3.85-3.94 | 3.86-3.95 | |

TABLE 5-continued

| Abrasive Grain Properties | | | | |
|---|---|---|---|---|
| | Ceramic D | Ceramic A | Ceramic B | Fusion C |
| Surface Area ($m^2/g$) | 0.12 max | 0.12 max | 0.12 max | |
| Loose Pack Density ($g/cm^3$) | 1.7-1.8 | 1.6-1.8 | 1.78-1.88 | |
| Aspect Ratio L:W:H | ~2.5:1:1? | ~2.5:1:1 | ~2:1:1 | ~2:1:1 |
| Aspect Ratio Specific Length (SL50) | | 2.4 | 2.1 | 2.0 |
| Shape | "very sharp" | "very sharp" | "sharp" | |
| Vickers Hardness | 20-24 GPa | 20-24 GPa | 20-23 GPa | 14-17 GPa |
| Fracture Toughness (MPa * $m^{1/2}$) | 2 | 2 | 2 | 3.5 |

TABLE 6

| Polymeric Size Coat Compositions | | | | | |
|---|---|---|---|---|---|
| | C1 (wt. %) | C2 (wt. %) | C3 (wt. %) | S1 (wt. %) | S2 (wt. %) |
| Phenolic Resin[1] | 52 | 52 | 52 | 52 | 52 |
| Toughening Agent[2] | 2.9 | 2.9 | 2.9 | — | — |
| Defoamer[3] | 0.2 | 0.2 | 0.2 | 0.2 | 0.2 |
| Wetting Agent[4] | 0.1 | 0.1 | 0.1 | — | — |
| Dispersant[5] | 0.9 | 0.9 | 0.9 | 0.9 | 0.9 |
| Pigment | 2 | 2 | 2 | 2 | 2 |
| Filler (Cryolite)[6] | 41 | 41 | 41 | 44 | 44 |
| Water | 0.9 | 0.9 | 0.9 | 0.9 | 0.9 |

Size weight: 26.8 lbs/ream (397 gsm), wet basis for all samples

[1]Phenolic resole, DeShen (China)

[2]Poly(trimethylene malonate)

[3]Dee Fo ®, Munzing Chemie GmbH

[4]Witcona 1260, Witco

[5]Tamol 165A

[6]Synthetic Cryolite

TABLE 7

| Polymeric Supersize Compositions | | | | | |
|---|---|---|---|---|---|
| | C1 (wt. %) | C2 (wt. %) | C3 (wt. %) | S1 (wt. %) | S2 (wt. %) |
| Phenolic Resin[1] | 23 | 23 | 23 | 23 | 23 |
| Color Stabilizer[2] | 0.1 | 0.1 | 0.1 | 0.1 | 0.1 |
| Defoamer[3] | 0.1 | 0.1 | 0.1 | 0.1 | 0.1 |
| Dispersant[4] | 1.7 | 1.7 | 1.7 | 1.7 | 1.7 |
| Pigment | 2 | 2 | 2 | 2 | 2 |
| Thickener[5] | 0.2 | 0.2 | 0.2 | 0.2 | 0.2 |

TABLE 7-continued

| Polymeric Supersize Compositions | | | | | |
|---|---|---|---|---|---|
| | C1 (wt. %) | C2 (wt. %) | C3 (wt. %) | S1 (wt. %) | S2 (wt. %) |
| Filler ($KBF_4$)[6] | 64 | 64 | 64 | 64 | 64 |
| Water | 8.9 | 8.9 | 8.9 | 8.9 | 8.9 |

Supersize weight: 22.6 lbs/ream (335 gsm), wet basis for all samples

[1]PF Prefere 80-5080A, Prefere Resins

[2]Color Stable

[3]Dee Fo ®, Munzing Chemie GmbH

[4]Daxad 11, GEO Specialty Chemicals

[5]Cab-O-Sil fumed silica

[6]Potassium tetrafluoroborate

Example 3: Abrasive Testing—304 Stainless Steel

The comparative belts (C1 and C2) and inventive abrasive belts (S1 and S2) were used to conduct automated abrasive performance testing on 304L Stainless Steel workpieces according to the procedure and conditions described below.

Test Procedure and Operating Conditions

Material Type: 304L SS

Work Size: 25 mm×6 mm

Material Geometry: 25×6

Hardness (HRB): 86

Density ($g/cm^3$): 7.86

Grinder Head: 40 HP KUKA Robot Cell

Motor RPM: 1820

Contact Wheel Type: Steel

Contact Wheel Dia. (mm): 400

Grinding Mode: SSF-P

Cut-off SGE (HP-min/$in^3$): 3.4 for three consecutive grinds

Tracks per belt: 2

Belt Length (mm): 3075

Belt Width (mm): 50

Cumulative material removed from the workpiece, Specific grinding energy, and cumulative material loss from the belt (i.e., belt wear) were monitored and recorded during the testing. The results of the abrasive testing are shown in Table 8 and FIGS. 8-9.

TABLE 8

Coated Abrasive Testing Results

| Name | Ceramic D | Ceramic A | Ceramic B | Fusion C | Abrasive Loose Pack Density (g/cm$^3$) | Relative Specific Grinding Energy Performance (HP/(in$^3$/min) | Cumulative Material Removed at threshold of 3.2 (HP/(in$^3$/min) (g) | Relative Cumulative Material Removed (As a % of C1) |
|---|---|---|---|---|---|---|---|---|
| C1 1-ply backing | 100 wt % | | — | — | 1.7-1.75 | Control | 963 | 100% |
| C3 2-ply backing | 100 wt % | | — | — | 1.7-1.75 | Slightly lower throughout grinding | 976 | 101% |
| S1 2-ply backing | | 30 wt % | 45 wt % | 25 wt % | 1.8 | Significantly lower from about 300 g onward of cumulative material removed | 1519 | 158% |
| S2 1-ply backing | | 30 wt % | 45 wt % | 25 wt % | 1.8 | Significantly lower from about 300g onward of cumulative material removed | 1895 | 197% |

Ceramic D—Exploded Ceramic Aluminum Oxide, MgO Doped 1.0 wt %, P36 grit size
Ceramic A—Exploded Ceramic Aluminum Oxide, MgO Doped 1.0 wt %, P30 grit size (Abrasive Particle Type 2)
Ceramic B—Crushed Ceramic Seeded Gel Aluminum Oxide, P30 grit size (Abrasive Particle Type 1)
Fusion C—Brown Fused Aluminum Oxide, P40 grit size-(Additive Particle)

Sample belts S1 and S2, which include an abrasive grain blend comprised of: an exploded ceramic aluminum oxide abrasive grain that is doped with MgO; a crushed ceramic aluminum oxide abrasive grain, and a crushed fusion aluminum oxide abrasive grain, both unexpectedly and surprisingly produced significantly improved abrasive performance compared to the comparative samples. S1 produced 158% of the performance of comparative belt C1. S2 produced 197% of the performance of comparative belt C1.

Figure 8:
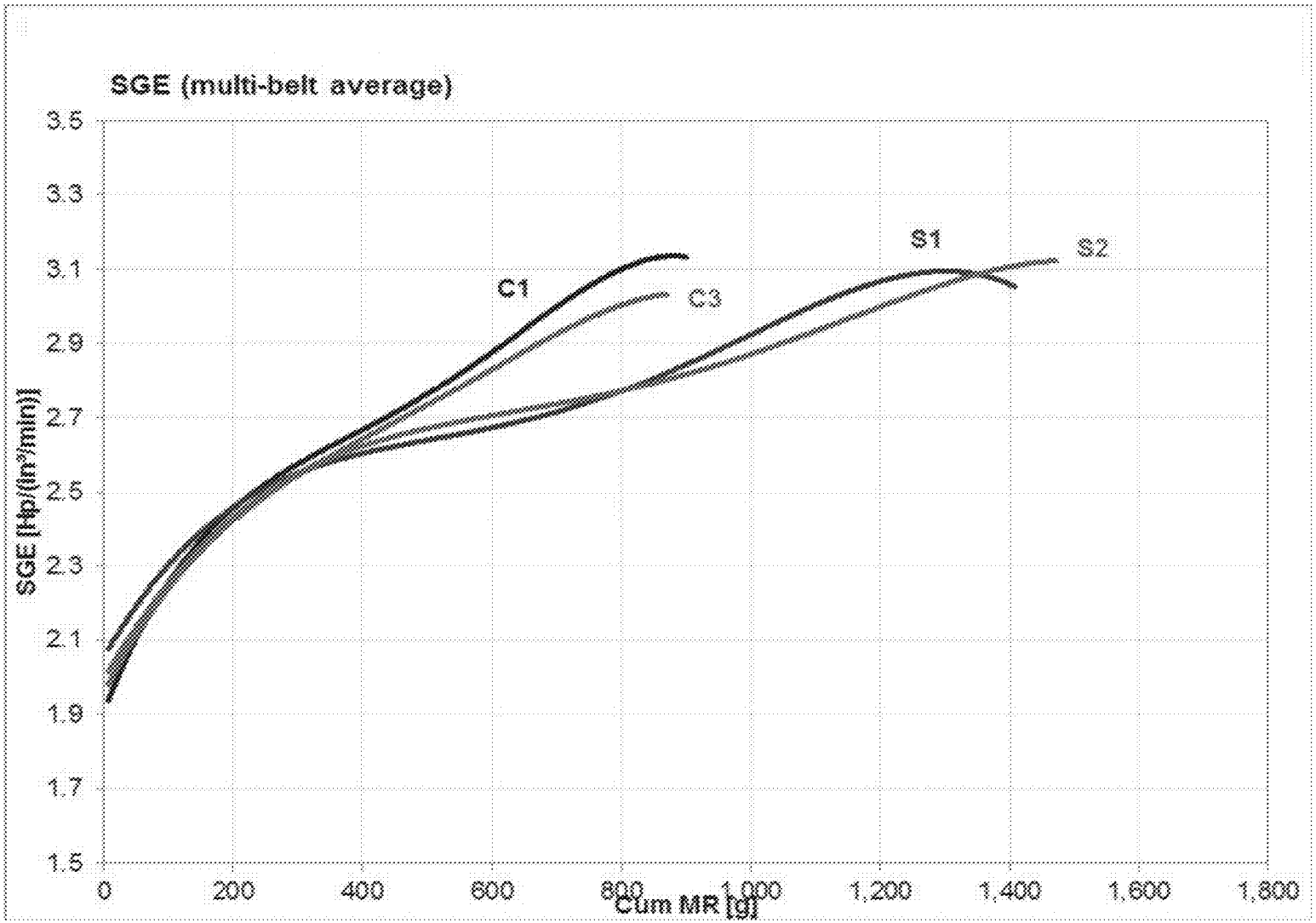
FIG. 8 is a chart showing the material removal performance versus specific grinding energy of inventive embodiments and comparative abrasive articles.
Figure 9:
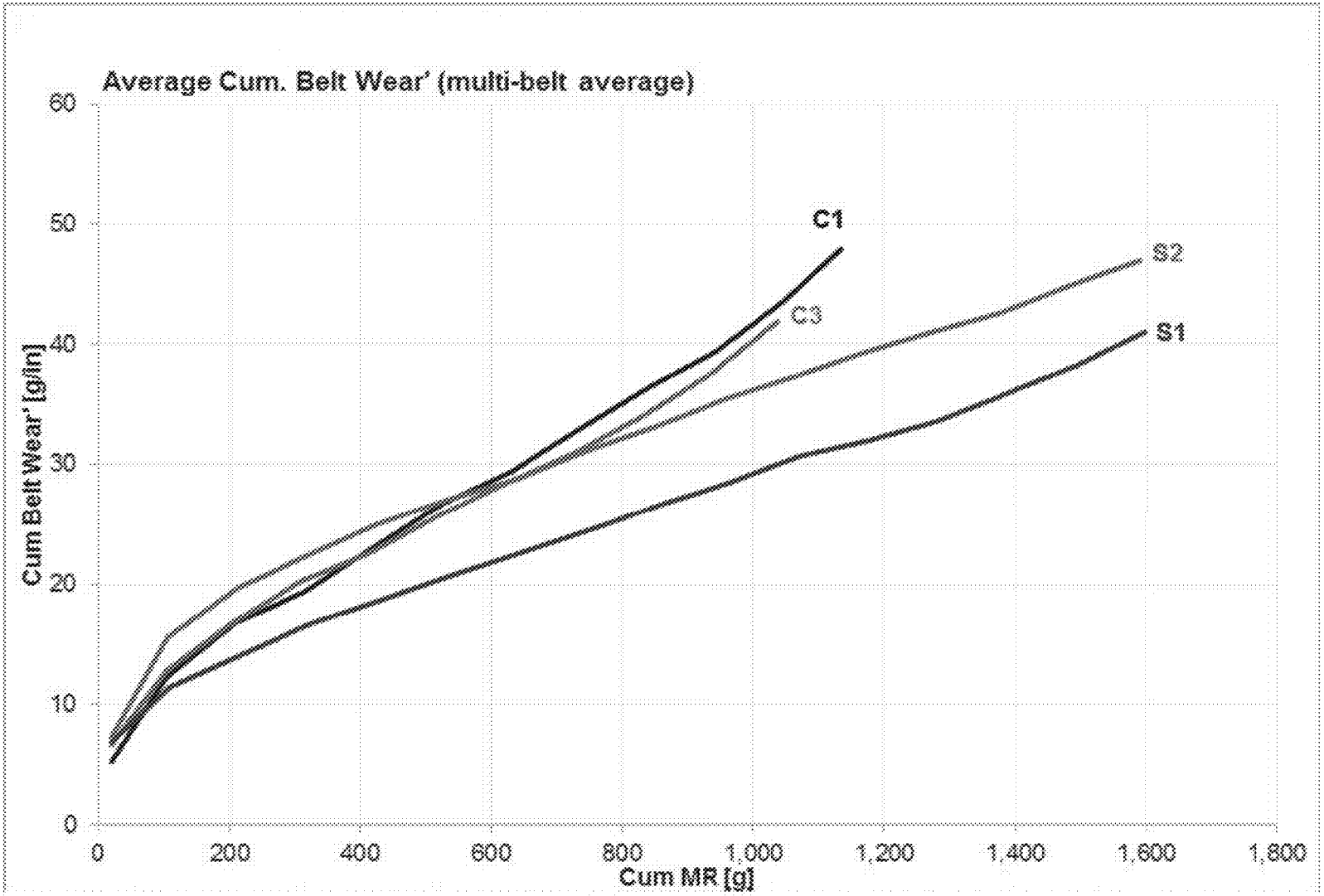
FIG. 9 is another chart showing the material removal performance versus cumulative belt wear of inventive embodiments and comparative abrasive articles.

As is shown in FIG. 8, both belts S1 and S2 were able to achieve significantly lower specific grinding energy with respect to the cumulative material removed compared to the C1 and C3 belts. Further, as shown in FIG. 9, the S1 and S2 belts were able to achieve significantly higher cumulative cut and much lower belt wear compared to C1 and C3.

Example 4: Abrasive Testing—304 Stainless Steel

Additional abrasive testing was conducted on 304L stainless steel workpieces according to the same procedures and conditions of Example 3. Again, cumulative material removed from the workpiece, Specific grinding energy, and cumulative material loss from the belt (i.e., belt wear) were monitored and recorded during the testing. The results of the abrasive testing are shown in Table 9 and FIGS. 6-7.

TABLE 9

Coated Abrasive Testing Results

| Name | Ceramic D | Ceramic A | Ceramic B | Fusion C | Relative Specific Grinding Energy Performance (HP/(in$^3$/min) | Cumulative Material Removed at threshold of 3.2 (HP/(in$^3$/min) (g) | Relative Cumulative Material Removed (As a % of C1) |
|---|---|---|---|---|---|---|---|
| C1 1-ply backing | 100 wt % | — | — | — | Control | 829 | 100% |
| C2 2-ply backing | — | 25 wt % | — | 75 wt % | Lower from about 100 g to 800 g of cumulative material removed, but soon exceeds allowed threshold at about 1000 g of cumulative material removed. | 1037 | 125% |

TABLE 9-continued

Coated Abrasive Testing Results

| Name | Ceramic D | Ceramic A | Ceramic B | Fusion C | Relative Specific Grinding Energy Performance (HP/(in$^3$/min) | Cumulative Material Removed at threshold of 3.2 (HP/(in$^3$/min) (g) | Relative Cumulative Material Removed (As a % of C1) |
|---|---|---|---|---|---|---|---|
| S1 2-ply backing | — | 30 wt % | 45 wt % | 25 wt % | Significantly lower from about 100 g to 1100 g of cumulative material removed. Does not exceed allowed threshold until over 1200 g of cumulative material removed. | 1277 | 154% |

Ceramic D—Exploded Ceramic Aluminum Oxide, MgO Doped 1.0 wt %, P36 grit size
Ceramic A—Exploded Ceramic Aluminum Oxide, MgO Doped 1.0 wt %, P30 grit size (Abrasive Particle Type 2)
Ceramic B—Crushed Ceramic Seeded Gel Aluminum Oxide, P30 grit size (Abrasive Particle Type 1)
Fusion C—Brown Fused Aluminum Oxide, P40 grit size-(Additive Particle)

Figure 6:
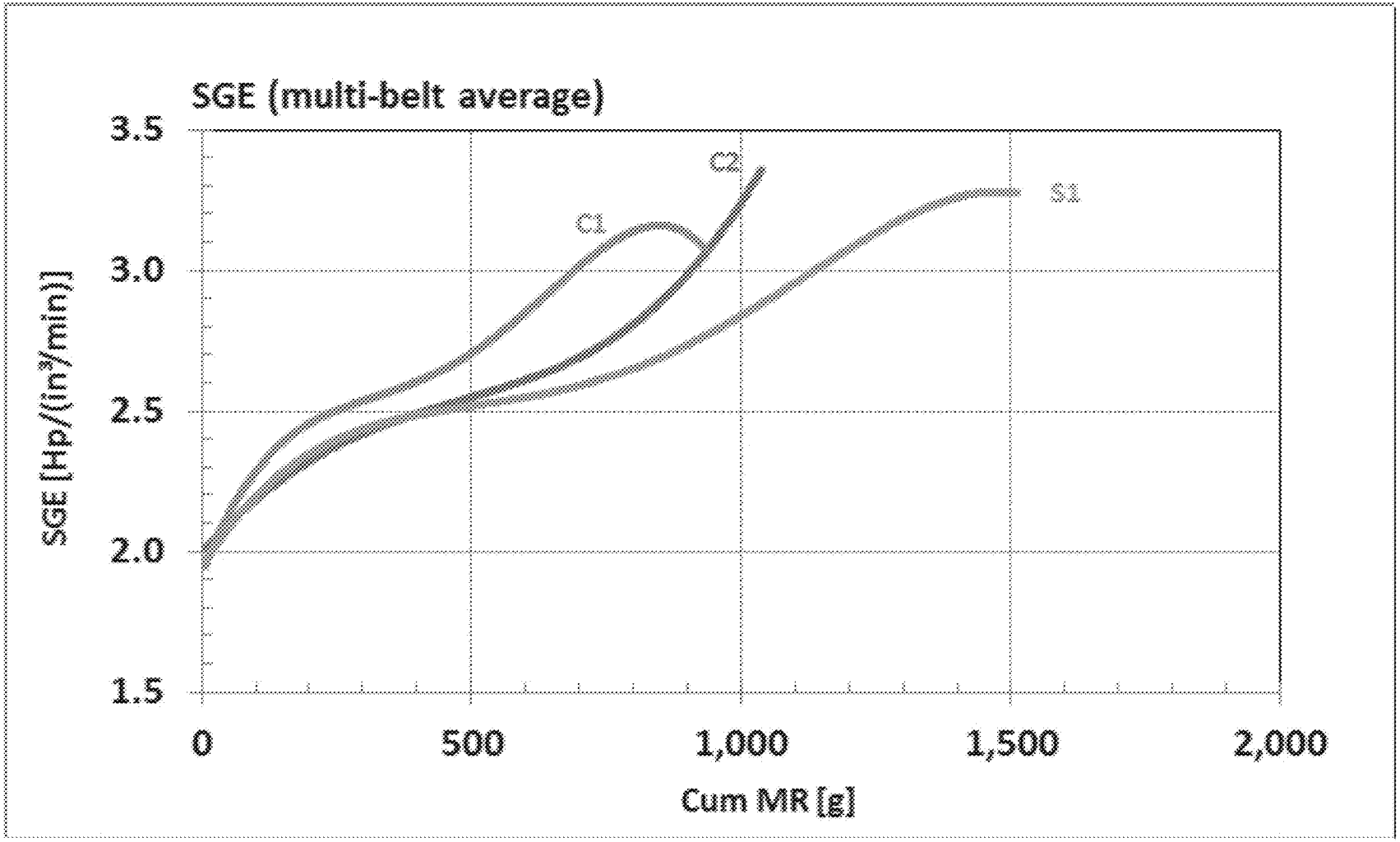
FIG. 6 is a chart showing the material removal performance versus specific grinding energy of inventive embodiments and comparative abrasive articles.
Figure 7:
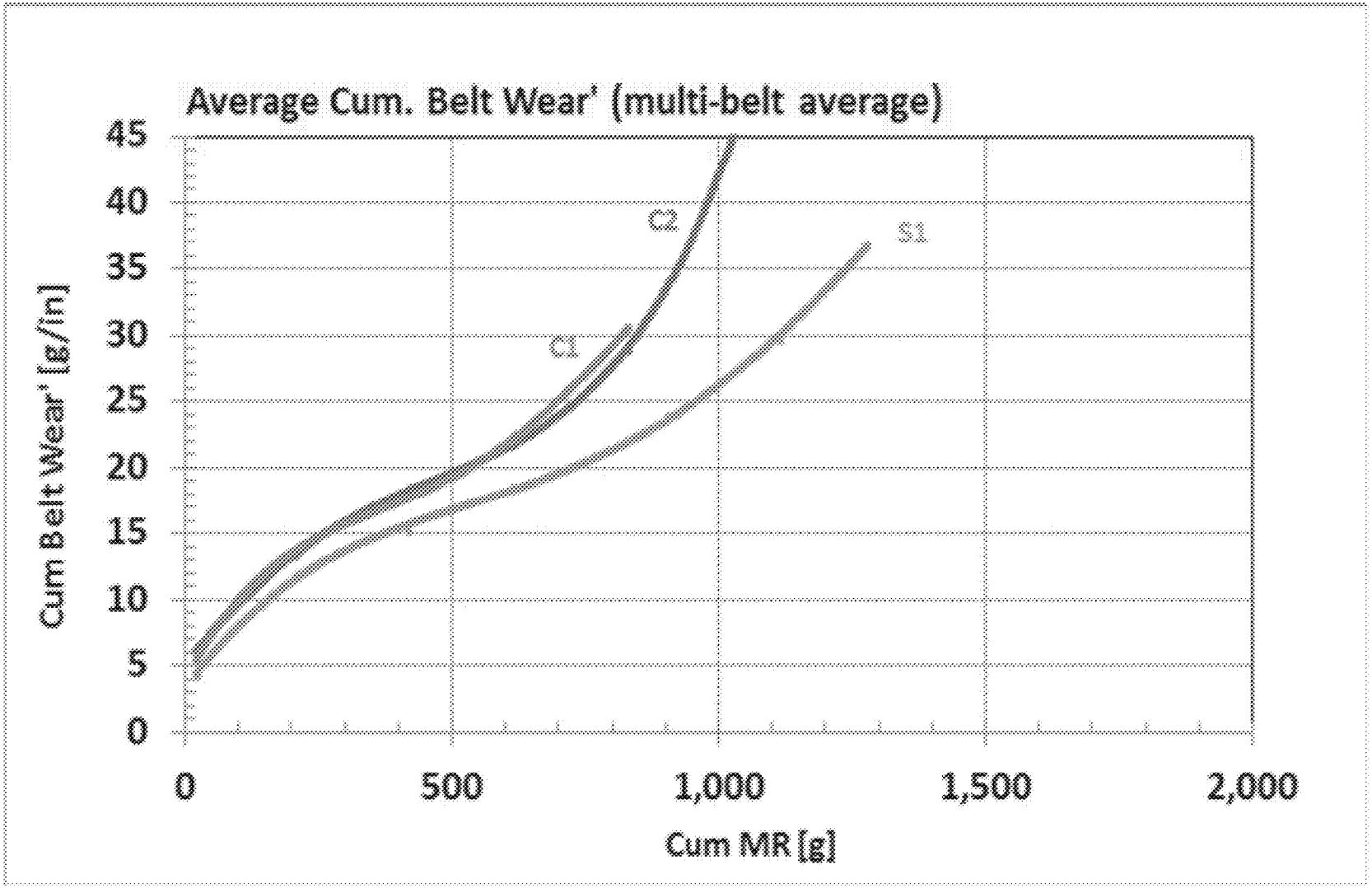
FIG. 7 is another chart showing the material removal performance versus cumulative belt wear of inventive embodiments and comparative abrasive articles.
Figure 10A:
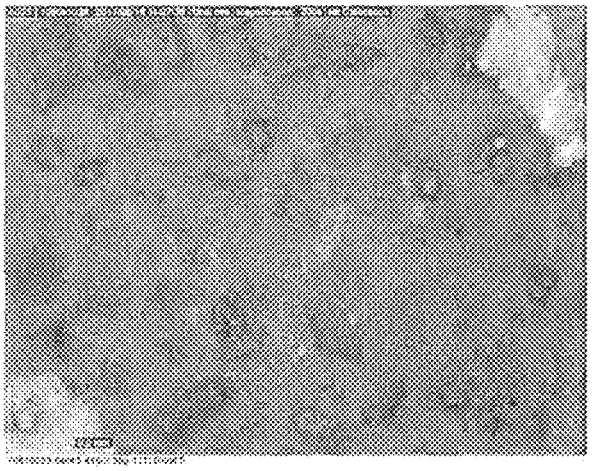
FIG. 10A is a magnified image of a comparative abrasive belt (C1) prior to use.
Figure 10B:
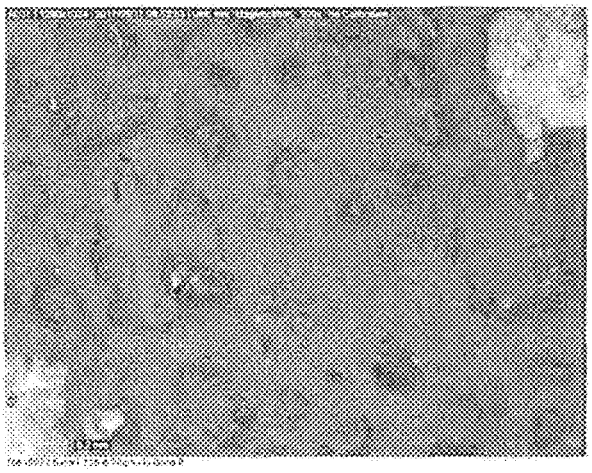
FIG. 10B is a magnified image of another comparative abrasive belt (C2) prior to use.
Figure 10C:
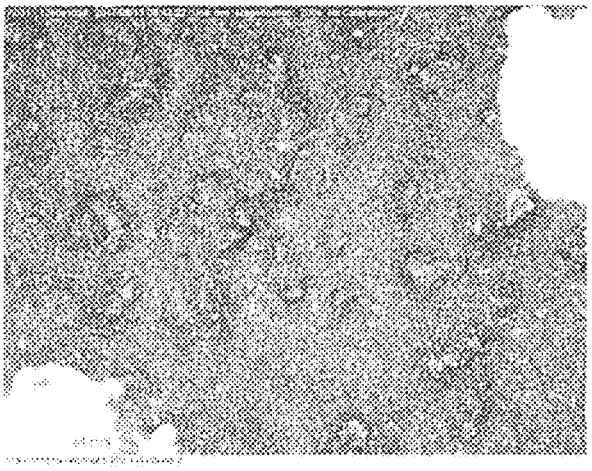
FIG. 10C is a magnified image of an inventive abrasive belt embodiment (S1) prior to use.
Figure 11A:
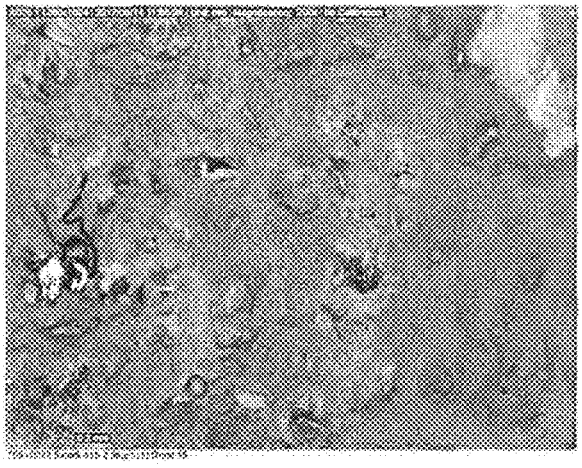
FIG. 11A is a magnified image of the same comparative abrasive belt (C1) after removing 100 g of material from a workpiece.
Figure 11B:
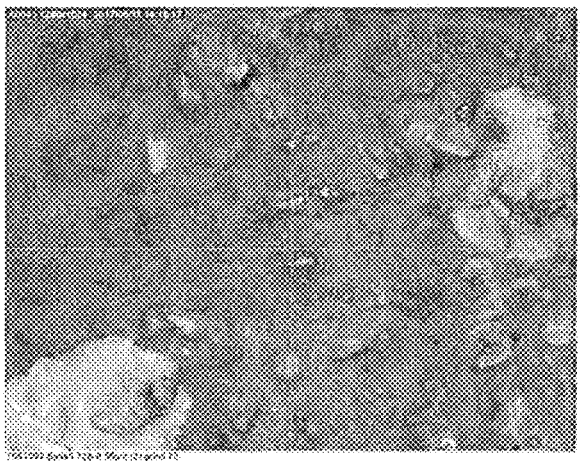
FIG. 11B is a magnified image of a comparative abrasive belt (C2) after removing 100 g of material from a workpiece.
Figure 11C:
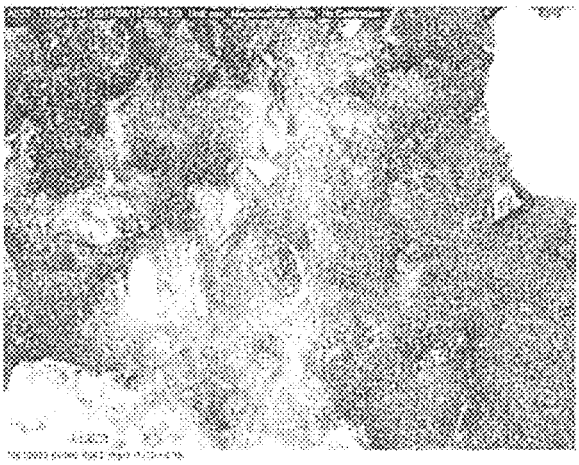
FIG. 11C is a magnified image of the inventive abrasive belt embodiment (S1) after removing 100 g of material from a workpiece.
Figure 12A:
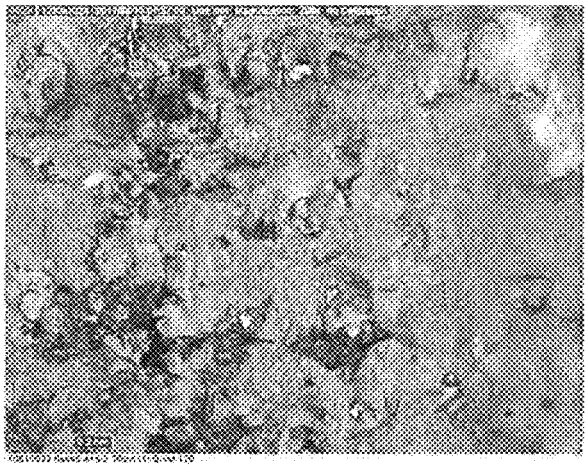
FIG. 12A is a magnified image of the comparative abrasive belt (C1) after removing 800 g of material from a workpiece.
Figure 12B:
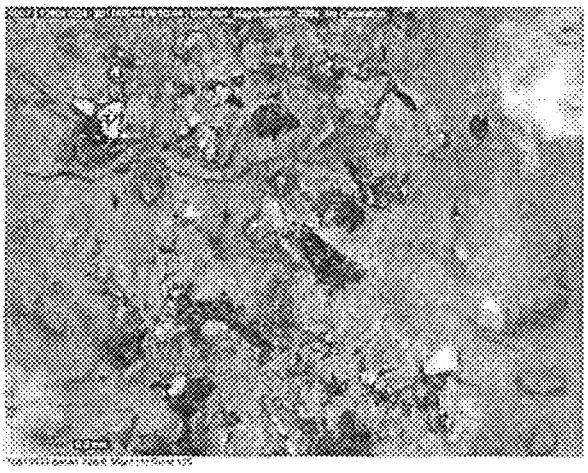
FIG. 12B is a magnified image of the comparative abrasive belt (C2) after removing 800 g of material from a workpiece.
Figure 12C:
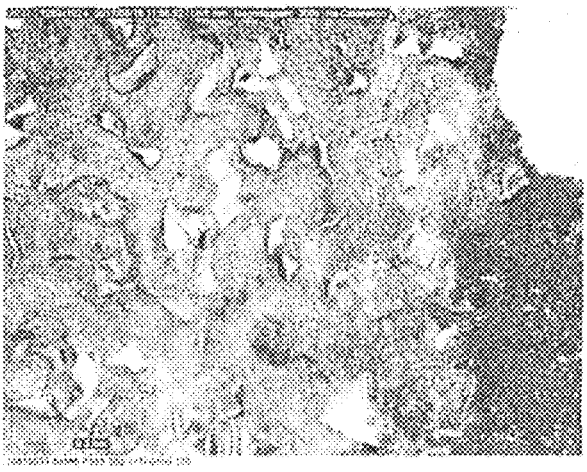
FIG. 12C is a magnified image of the inventive abrasive belt embodiment (S1) after removing 800 g of material from a workpiece.
Figure 13A:
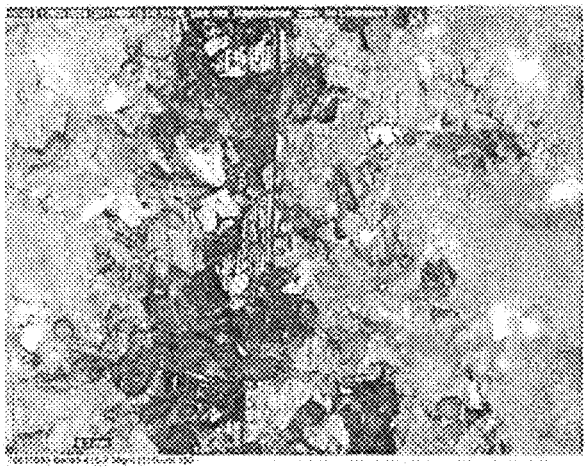
FIG. 13A is a magnified image of the comparative abrasive belt (C1) after removing 1000 g of material from a workpiece.
Figure 13B:
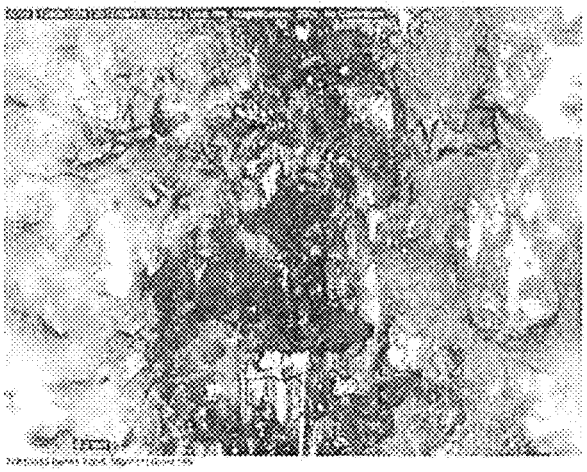
FIG. 13B is a magnified image of the comparative abrasive belt (C2) after removing 1000 g of material from a workpiece.
Figure 13C:
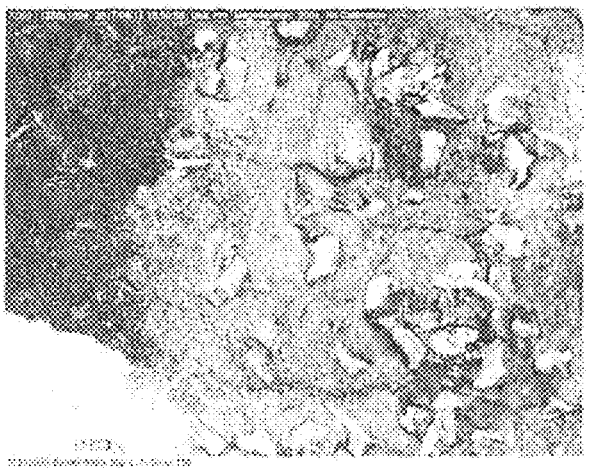
FIG. 13C is a magnified image of the inventive abrasive belt embodiment (S1) after removing 1000 g of material from a workpiece.
Figure 14:
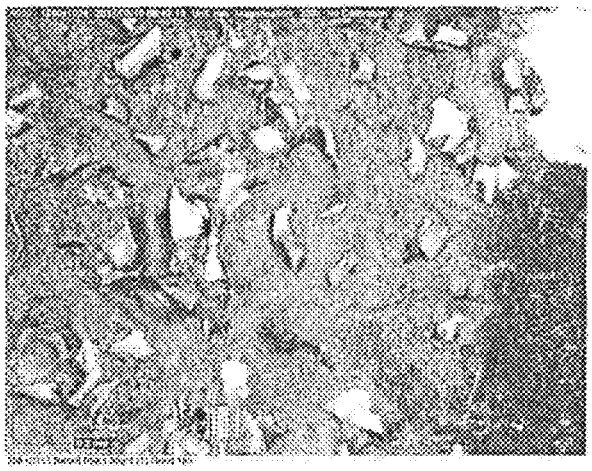
FIG. 14 is a magnified image of the inventive abrasive belt embodiment (S1) after removing 1200 g of material from a workpiece.

As is shown in FIG. 6, belt S1 was able to achieve significantly lower specific grinding energy with respect to the cumulative material removed compared to the C1 and C2 belts. Further, as shown in FIG. 7, the S1 belt was able to achieve significantly higher cumulative cut and much lower belt wear compared to both the C1 and C2 belts. FIGS. 10-14 show the surface of the abrasive belts C1, C2, and S1 at periodic intervals during the grinding testing. FIGS. 10A-C show the belt surface prior to use. FIGS. 11A-C show the belt surfaces after 100 g of material have been removed from the workpiece. FIGS. 11A and B show the C1 and C2 belts have some initial grit fracture. FIG. 11C of S1 belt shows some initial grit fracture and wear of the supersize. FIGS. 12A-C show the belt surfaces after 800 g of material have been removed from the workpiece. FIGS. 12A and B show the C1 and C2 belts have grit fracture, metal capping, grit pullout, and resin wear. FIG. 11C of S1 belt shows some grit fracture, some metal capping, and some resin wear. FIGS. 13A-C show the belt surfaces after 1000 g of material have been removed from the workpiece. FIG. 13A show the C1 belt, which failed prior to the full 1000 g of removal, has increased grit fracture, increasing metal capping, significant grit pullout, and resin wear. FIG. 13B shows the C2 belt has significant grit fracture, increasing metal capping, and grit pullout. FIG. 13C of S1 belt shows grit fracture, some metal capping, and resin wear. The comparative belts C1 and C2 both fail prior to removing 1200 g of material from the workpiece. FIG. 14 shows the surface of sample belt S1 after 1200 g of removal from the workpiece. FIG. 14 shows grit fracture, some metal capping, and resin wear. FIG. 15 shows the second type of abrasive particle. FIG. 16 shows the first type of abrasive particle.

Embodiments

Embodiment 1: An abrasive article comprising: a substrate; and an abrasive layer overlying the substrate, wherein the abrasive layer comprises a blend of abrasive particles including a first type of abrasive particle comprising a polycrystalline material and having a first average friability $F_1$, a second type of abrasive particle comprising a polycrystalline material and having a second average friability, $F_2$, and an additive particle, wherein the blend comprises a average friability difference, $\Delta F=|F_1-F_2|$, within a range of at least 0.5% to not greater than 80%.

Embodiment 2: An abrasive article comprising: a substrate; at least one adhesive layer overlying the substrate; and an abrasive layer overlying the substrate, wherein the abrasive layer comprises a blend of abrasive particles including: a first type of abrasive particle comprising alumina having an average crystallite size of less than 1 micron and having a loose pack density within a range of 1.71-1.91 g/cc; a second type of abrasive particle comprising alumina having an average crystallite size of less than 1 micron and having a loose pack density within a range of 1.64-1.8 g/cc; and an additive particle.

Embodiment 3: The abrasive article of any of embodiments 1 and 2, wherein the additive particle comprises a filler or third type of abrasive particle.

Embodiment 4: The abrasive article of any of embodiments 1 and 2, wherein the additive particle comprises brown fused alumina ($Al_2O_3$).

Embodiment 5: The abrasive article of any of embodiments 1 and 2, wherein the additive particle comprises an average particle size, $D50_{AP}$, of not greater than 1000 μm or not greater than 500 μm or not greater than 400 μm or not greater than 300 μm or not greater than 200 μm or not greater than 100 μm or not greater than 50 μm or not greater than 25 μm or not greater than 10 μm.

Embodiment 6: The abrasive article of any of embodiments 1 and 2, wherein the additive particle comprises an average particle size, $D50_{AP}$, of at least 5 μm or at least 10 μm or at least 25 μm or at least 50 μm or at least 100 μm or at least 200 μm or at least 300 μm or at least 400 μm or at least 500 μm.

Embodiment 7: The abrasive article of any of embodiments 1 and 2, wherein the additive particle comprises an average particle size, $D50_{AP}$, within the range of at least 5 μm but not greater than 1000 μm.

Embodiment 8: The abrasive article of any of embodiments 1 and 2, further comprising at least 5 lbs/ream and no greater than 20 lbs/ream of the additive particle overlying the substrate.

Embodiment 9: The abrasive article of any of embodiments 1 and 2, wherein the first type of abrasive particle comprises alumina.

Embodiment 10: The abrasive article of any of embodiments 1 and 2, wherein the first type of abrasive particle consists essentially of alumina.

Embodiment 11: The abrasive article of any of embodiments 1 and 2, wherein the first type of abrasive particle comprises a seeded sol-gel particle.

Embodiment 12: The abrasive article of any of embodiments 1 and 2, wherein the first type of abrasive particles comprise average crystallite size of not greater than 10 μm, not greater than 8 μm, not greater than 5 μm, not greater than 2 μm, not greater than 1 μm, not greater than 0.5 μm, or not greater than 0.2 μm.

Embodiment 13: The abrasive article of embodiment 12, wherein the first type of abrasive particles comprise average crystallite size in a range of about 0.01 μm-about 10 μm, in a range of about 0.01 μm-about 1 μm, or in a range of about 0.005 μm-about 0.2 μm.

Embodiment 14: The abrasive article of any of embodiments 1 and 2, wherein the first type of abrasive particle comprises an average particle size, $D50_{T1}$, of not greater than 2000 μm.

Embodiment 15: The abrasive article of any of embodiments 1 and 2, wherein the first type of abrasive particle comprises an average particle size, $D50_{T1}$, of at least 0.5 μm.

Embodiment 16: The abrasive article of any of embodiments 1 and 2, wherein the first type of abrasive particle comprises an average particle size, $D50_{T1}$, within the range of at least 0.5 μm but not greater than 2000 μm.

Embodiment 17: The abrasive article of embodiment 16, further comprising an additive particle comprising an average particle size, $D50_{AP}$, and further comprising a first particle size ratio, $[D50_{T1}:D50_{AP}]$, of not greater than 100:1, not greater than 90:1, not greater than 80:1, not greater than 70:1, not greater than 60:1, not greater than 50:1, not greater than 40:1, not greater than 30:1, not greater than 20:1, not greater than 10:1, not greater than 5:1, not greater than 4:1, not greater than 3:1, not greater than 2:1, or not greater than 1.1:1.

Embodiment 18: The abrasive article of embodiment 16, further comprising an additive particle comprising an average particle size, $D50_{AP}$, and further comprising a first particle size ratio, $[D50_{T1}:D50_{AP}]$, of at least 1:1.1, at least 2:1, at least 3:1, at least 4:1, at least 5:1, at least 10:1, at least 20:1, at least 30:1, at least 40:1, at least 50:1, at least 60:1, at least 70:1, at least 80:1, at least 90:1, at least 100:1.

Embodiment 19: The abrasive article of embodiment 16, further comprising an additive particle comprising an average particle size, $D50_{AP}$, and further comprising a first particle size ratio, $[D50_{T1}:D50_{AP}]$, within the range of at least 1.1:1 but not greater than 100:1.

Embodiment 20: The abrasive article of any of embodiments 1 and 2, wherein the first type of abrasive particle comprises an irregular shape.

Embodiment 21: The abrasive article of embodiment 20, wherein the first type of abrasive particle comprises a crushed grain.

Embodiment 22: The abrasive article of any of embodiments 1 and 2, wherein the first type of abrasive particle has a length, $L_{T1}$, a width, $W_{T1}$, and a thickness, $T_{T1}$, and wherein $L_{T1} \geq W_{T1} \geq T_{T1}$.

Embodiment 23: The abrasive article of embodiment 22, wherein the first type of abrasive particle comprises a primary aspect ratio, $\Theta^1_{T1}=[L_{T1}:W_{T1}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1.

Embodiment 24: The abrasive article of embodiment 22, wherein the first type of abrasive particle comprises a primary aspect ratio, $\Theta^1_{T1}=[L_{T1}:W_{T1}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

Embodiment 25: The abrasive article of embodiment 22, wherein the first type of abrasive particle comprises a secondary aspect ratio, $\Theta^2_{T1}=[W_{T1}:T_{T1}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1.

Embodiment 26: The abrasive article of embodiment 22, wherein the first type of abrasive particle comprises a secondary aspect ratio, $\Theta^2_{T1}=[W_{T1}:T_{T1}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

Embodiment 27: The abrasive article of embodiment 22, wherein the first type of abrasive particle comprises a tertiary aspect ratio, $\Theta^3_{T1}=[L_{T1}:T_{T1}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1.

Embodiment 28: The abrasive article of embodiment 22, wherein the first type of abrasive particle comprises a tertiary aspect ratio, $\Theta^3_{T1}=[L_{T1}:T_{T1}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

Embodiment 29: The abrasive article of any of embodiments 1 and 2, wherein the blend comprises at least 5 lbs/ream and no greater than 30 lbs/ream of the first type of abrasive particle overlying the substrate.

Embodiment 30: The abrasive article of any of embodiments 1 and 2, wherein the blend comprises at least 1 wt % of the first type of abrasive particle for the total weight of the blend.

Embodiment 31: The abrasive article of any of embodiments 1 and 2, wherein the blend comprises no greater than 95 wt % of the first type of abrasive particle for the total weight of the blend, no greater than 90 wt %, no greater than 85 wt %, no greater than 80 wt %, no greater than 75 wt %, no greater than 70 wt %, no greater than 65 wt %, no greater than 60 wt %, no greater than 55 wt %, no greater than 50 wt %, no greater than 45 wt %, no greater than 40 wt %, no greater than 35 wt %, no greater than 30 wt %, no greater than 25 wt %, no greater than 20 wt %, no greater than 15 wt %, no greater than 10 wt %, no greater than 5 wt %, or no greater than 1 wt % of the first type of abrasive particle for the total weight of the blend.

Embodiment 32: The abrasive article of any of embodiments 1 and 2, wherein the blend comprises at least 5 wt % of the first type of abrasive particle for the total weight of the blend, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of the first type of abrasive particle for the total weight of the blend.

Embodiment 33: The abrasive article of any of embodiments 1 and 2, wherein the blend comprises at least 1 wt % and no greater than 95 wt % of the first type of abrasive particle for the total weight of the blend.

Embodiment 34: The abrasive article of any of embodiments 1 and 2, wherein the first type of abrasive particle comprises an average friability, $F_1$, of not greater than 0.6.

Embodiment 35: The abrasive article of any of embodiments 1 and 2, wherein the first type of abrasive particle comprises an average friability, $F_1$, of at least 0.55.

Embodiment 36: The abrasive article of any of embodiments 1 and 2, wherein the first type of abrasive particle comprises an average friability, $F_1$, within the range of at least 0.55 but not greater than 0.6.

Embodiment 37: The abrasive article of any of embodiments 1 and 2, wherein the second type of abrasive particle comprises alumina.

Embodiment 38: The abrasive article of any of embodiments 1 and 2, wherein the second type of abrasive particles comprise an average crystallite size of not greater than 10 μm, not greater than 8 μm, not greater than 5 μm, not greater than 2 μm, not greater than 1 μm, not greater than 0.5 μm, not greater than 0.2 μm.

Embodiment 39: The abrasive article of embodiment 38, wherein the second type of abrasive particles comprise an average crystallite size in a range of about 0.01 μm-about 10 μm, in a range of about 0.01 μm-about 1 μm, or in a range of about 0.005 μm-about 0.2 μm.

Embodiment 40: The abrasive article of any of embodiments 1 and 2, wherein the second type of abrasive particle comprises an average particle size, $D50_{T2}$, of not greater than 2000 μm.

Embodiment 41: The abrasive article of any of embodiments 1 and 2, wherein the second type of abrasive particle comprises an average particle size, $D50_{r2}$, of at least 0.5 μm.

Embodiment 42: The abrasive article of any of embodiments 1 and 2, wherein the second type of abrasive particle comprises an average particle size, $D50_{T2}$, within the range of at least 0.5 μm but not greater than 2000 μm.

Embodiment 43: The abrasive article of embodiment 42, further comprising an additive particle comprising an average particle size, $D50_{AP}$, and further comprising a second particle size ratio, $[D50_{T2}:D50_{AP}]$, of not greater than 100:1, not greater than 90:1, not greater than 80:1, not greater than 70:1, not greater than 60:1, not greater than 50:1, not greater than 40:1, not greater than 30:1, not greater than 20:1, not greater than 10:1, not greater than 5:1, not greater than 4:1, not greater than 3:1, not greater than 2:1, or not greater than 1.1:1.

Embodiment 44: The abrasive article of embodiment 42, further comprising an additive particle comprising an average particle size, $D50_{AP}$, and further comprising a second particle size ratio, $[D50_{T2}:D50_{AP}]$, of at least 1:1.1, at least 2:1, at least 3:1, at least 4:1, at least 5:1, at least 10:1, at least 20:1, at least 30:1, at least 40:1, at least 50:1, at least 60:1, at least 70:1, at least 80:1, at least 90:1, at least 100:1.

Embodiment 45: The abrasive article of embodiment 42, further comprising an additive particle comprising an average particle size, $D50_{AP}$, and further comprising a second particle size ratio, $[D50_{T2}:D50_{AP}]$, within the range of at least 1.1:1 but not greater than 100:1.

Embodiment 46: The abrasive article of any of embodiments 1 and 2, wherein the second type of abrasive particle comprises an irregular shape.

Embodiment 47: The abrasive article of embodiment 46, wherein the second type of abrasive particle comprises an exploded grain.

Embodiment 48: The abrasive article of embodiment 46, wherein the second type of abrasive particle comprises a sol-gel alumina grain.

Embodiment 49: The abrasive article of any of embodiments 1 and 2, wherein the second type of abrasive particle has a length, $L_{T2}$, a width, $W_{T2}$, and a thickness, $T_{T2}$, and wherein $L_{T2} \geq W_{T2} \geq T_{T2}$.

Embodiment 50: The abrasive article of embodiment 49, wherein the second type of abrasive particle comprises a primary aspect ratio, $\Theta^1_{T2}=[L_{T2}:W_{T2}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1.

Embodiment 51: The abrasive article of embodiment 49, wherein the second type of abrasive particle comprises a primary aspect ratio, $\Theta^1_{T2}=[L_{T2}:W_{T2}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

Embodiment 52: The abrasive article of embodiment 49, wherein the second type of abrasive particle comprises a secondary aspect ratio, $\Theta^2_{T2}=[W_{T2}:T_{T2}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1.

Embodiment 53: The abrasive article of embodiment 49, wherein the second type of abrasive particle comprises a secondary aspect ratio, $\Theta^2_{T2}=[W_{T2}:T_{T2}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

Embodiment 54: The abrasive article of embodiment 49, wherein the second type of abrasive particle comprises a tertiary aspect ratio, $\Theta^3_{T2}=[L_{T2}:T_{T2}]$, of at least 1.1:1, at least 1.5:1, at least 2:1, at least 3:1, at least 4:1, or at least 5:1 or at least 8:1 or at least 10:1 or at least 20:1 or at least 30:1 or at least 40:1 or at least 50:1 or at least 70:1 or at least 100:1.

Embodiment 55: The abrasive article of embodiment 49, wherein the second type of abrasive particle comprises a tertiary aspect ratio, $\Theta^3_{T2}=[L_{T2}:T_{T2}]$, of no greater than 500:1, no greater than 400:1, no greater than 300:1, no greater than 200:1, no greater than 100:1, or no greater than 50:1 or not greater than 20:1 or not greater than 10:1 or not greater than 5:1 or not greater than 3:1.

Embodiment 56: The abrasive article of any of embodiments 1 and 2, further comprising at least 5 lbs/ream and no greater than 30 lbs/ream of the second type of abrasive particle overlying the substrate.

Embodiment 57: The abrasive article of any of embodiments 1 and 2, wherein the blend comprises at least 1 wt % of the second type of abrasive particle for the total weight of the blend.

Embodiment 58: The abrasive article of any of embodiments 1 and 2, wherein the blend comprises no greater than 95 wt % of the second type of abrasive particle for the total weight of the blend, no greater than 90 wt %, no greater than 85 wt %, no greater than 80 wt %, no greater than 75 wt %, no greater than 70 wt %, no greater than 65 wt %, no greater than 60 wt %, no greater than 55 wt %, no greater than 50 wt %, no greater than 45 wt %, no greater than 40 wt %, no greater than 35 wt %, no greater than 30 wt %, no greater than 25 wt %, no greater than 20 wt %, no greater than 15 wt %, no greater than 10 wt %, no greater than 5 wt %, or no greater than 1 wt % of the second type of abrasive particle for the total weight of the blend.

Embodiment 59: The abrasive article of any of embodiments 1 and 2, wherein the blend comprises at least 5 wt % of the second type of abrasive particle for the total weight of the blend, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of the second type of abrasive particle for the total weight of the blend.

Embodiment 60: The abrasive article of any of embodiments 1 and 2, wherein the blend comprises at least 1 wt % and no greater than 95 wt % of the second type of abrasive particle for the total weight of the blend.

Embodiment 61: The abrasive article of any of embodiments 1 and 2, wherein the second type of abrasive particle comprises an average friability, $F_2$, of not greater than 0.70.

Embodiment 62: The abrasive article of any of embodiments 1 and 2, wherein the second type of abrasive particle comprises an average friability, $F_2$, of at least 0.62.

Embodiment 63: The abrasive article of any of embodiments 1 and 2, wherein the second type of abrasive particle comprises an average friability, $F_2$, within the range of at least 0.62 but not greater than 0.70.

Embodiment 64: The abrasive article of any of embodiments 1 and 2, wherein the first type of abrasive particle comprises an average particle size, $D50_{T1}$, wherein the second type of abrasive particle comprises an average particle size, $D50_{T2}$, and further comprising an average particle size difference, $\Delta D50=|D50_{T1}-D50_{T2}|$, of not greater than 600 μm.

Embodiment 65: The abrasive article of any of embodiments 1 and 2, wherein the second type of abrasive particle comprises an average particle size, $D50_{T2}$, and further comprising an average particle size difference, $\Delta D50=|D50_{T1}-D50_{T2}|$, of at least 0.1 μm.

Embodiment 66: The abrasive article of any of embodiments 1 and 2, wherein the second type of abrasive particle comprises an average particle size, $D50_{T2}$, and further comprising an average particle size difference, $\Delta D50=|D50_{T1}:-D50_{T2}|$, within the range of at least 0.1 μm but not greater than 600 μm.

Embodiment 67: The abrasive article of any of embodiments 1 and 2, wherein the first type of abrasive particle comprise alumina oxide with at least one dopant selected from the group consisting of alkali elements, alkaline earth elements, rare-earth elements, hafnium (Hf), zirconium (Zr), niobium (Nb), tantalum (Ta), molybdenum (Mo), vanadium (V), or any combination thereof.

Embodiment 68: The abrasive article of embodiment 67, wherein the first type of abrasive particle comprises alumina and a dopant including magnesium oxide (MgO).

Embodiment 69: The abrasive article of embodiment 67, wherein the first type of abrasive particle consists essentially of alpha alumina, comprising at least 99.5% alpha alumina for the first type of abrasive particle.

Embodiment 70: The abrasive article of any of embodiments 1 and 2, wherein the second type of abrasive particle comprise alumina oxide with at least one dopant selected from the group consisting of alkali elements, alkaline earth elements, rare-earth elements, hafnium (Hf), zirconium (Zr), niobium (Nb), tantalum (Ta), molybdenum (Mo), vanadium (V), or any combination thereof.

Embodiment 71: The abrasive article of embodiment 70, wherein the second type of abrasive particle comprises alumina and a dopant including magnesium oxide (MgO).

Embodiment 72: The abrasive article of embodiment 70, wherein the second type of abrasive particle comprises magnesium oxide (MgO) in a range between about 0.5 wt % to about 15 wt %.

Embodiment 73: The abrasive article of any of embodiments 1 and 2, wherein the first type of abrasive particles has a loose pack density, $\eta_1$, of not greater than 1.91 g/cm$^3$.

Embodiment 74: The abrasive article of any of embodiments 1 and 2, wherein the first type of abrasive particles has a loose pack density, $\eta_1$, of at least 1.71 g/cm$^3$.

Embodiment 75: The abrasive article of any of embodiments 1 and 2, wherein the first type of abrasive particles has a loose pack density, $\eta_1$, of at least 1.71 g/cm$^3$ and not greater than 1.91 g/cm$^3$.

Embodiment 76: The abrasive article of any of embodiments 1 and 2, wherein the second type of abrasive particles has a loose pack density, $\eta_2$, of not greater than 1.8 g/cm$^3$.

Embodiment 77: The abrasive article of any of embodiments 1 and 2, wherein the second type of abrasive particles has a loose pack density, $\eta_2$, of at least 1.64 g/cm$^3$.

Embodiment 78: The abrasive article of any of embodiments 1 and 2, wherein the second type of abrasive particles has a loose pack density, $\eta_2$, of at least 1.64 g/cm$^3$ and not greater than 1.8 g/cm$^3$.

Embodiment 79. An abrasive article comprising:

a substrate; and an abrasive layer overlying the substrate, wherein the abrasive layer comprises a binder and a blend of abrasive particles dispersed on or in the binder, wherein the blend of abrasive particles includes:

a first type of abrasive particle comprising a first polycrystalline material, a second type of abrasive particle comprising a second polycrystalline material; and an additive particle.

Embodiment 80. The abrasive article of embodiment 79, wherein the first polycrystalline material comprises a first average friability $F_1$, wherein the second polycrystalline material comprises a second average friability, $F_2$, wherein the blend comprises an average friability difference, $\Delta F=|F_1-F_2|$, within a range of at least 0.5% to not greater than 80%.

Embodiment 81. The abrasive article of embodiment 79, wherein the first type of abrasive particle comprises a first ceramic alumina, and wherein the second type of abrasive particle comprises a second ceramic alumina.

Embodiment 82. The abrasive article of embodiment 81, wherein the first ceramic alumina comprises a sol-gel alumina grain.

Embodiment 83. The abrasive article of embodiment 82, wherein the first ceramic alumina comprises an exploded grain.

Embodiment 84. The abrasive article of embodiment 82, wherein the first ceramic alumina comprises a dopant including magnesium oxide (MgO) in an amount of not less than 0.5 wt % and not greater than 10 wt %.

Embodiment 85. The abrasive article of embodiment 81, wherein the second ceramic alumina comprises a sol-gel alumina grain.

Embodiment 86. The abrasive article of embodiment 84, wherein the second ceramic alumina comprises a roller crushed grain.

Embodiment 87. The abrasive article of embodiment 81, wherein the first ceramic alumina comprises an average crystallite size of not less than 0.01 μm and not greater than 1 micron.

Embodiment 88. The abrasive article of embodiment 86 wherein the second ceramic alumina comprises an average crystallite size of not less than 0.01 μm and not greater than 1 micron.

Embodiment 89. The abrasive article of embodiment 81, wherein the additive particle comprises a fusion alumina.

Embodiment 90. The abrasive article of embodiment 82, wherein the blend of abrasive particles comprises a loose pack density, $\eta_{blend}$, of at least 1.5 g/cc and not greater than 2 g/cc.

Embodiment 91. The abrasive article of embodiment 85, wherein the first ceramic alumina comprises and a loose pack density of 1.6-1.8 g/cc.

Embodiment 92. The abrasive article of embodiment 86, wherein the second ceramic alumina comprises a loose pack density within a range of 1.78-1.88 g/cc.

Embodiment 93. The abrasive article of embodiment 88, wherein the fusion alumina comprises brown fused alumina ($Al_2O_3$).

Embodiment 94. The abrasive article of embodiment 81, wherein the blend comprises at least 1 wt % and not greater than 40 wt % of the first type of abrasive particle for the total weight of the blend.

Embodiment 95. The abrasive article of embodiment 89, wherein the blend comprises at least 1 wt % and not greater than 50 wt % of the first type of abrasive particle for the total weight of the blend.

Embodiment 96. The abrasive article of embodiment 90, wherein the blend comprises at least 1 wt % and not greater than 40 wt % of the additive particle for the total weight of the blend.

Embodiment 97. The abrasive article of embodiment 80, wherein the first type of abrasive particle comprises an average friability, $F_1$, of at least 0.55 and not greater than 0.6.

Embodiment 98. The abrasive article of embodiment 80, wherein the second type of abrasive particle comprises an average friability, $F_2$, of at least 0.62 and not greater than 0.7.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity cannot be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. A method of forming an abrasive article comprising:
providing a backing material;
disposing a binder over the backing material;
dispersing a blend of abrasive particles comprising a plurality of first type of abrasive particles on the binder layer and dispersing a plurality of second type of abrasive particles on the binder layer;
wherein the first type of abrasive particle has a first average friability F1 and the second type of abrasive particle has a second average friability F2;
and wherein the blend of abrasive particles comprises an average friability difference, $\Delta F=|F1-F2|$, within a range of at least 0.5% to not greater than 80%,
wherein the blend of abrasive particles further comprises additive particles comprising brown fused alumina,
wherein the first type of abrasive particle comprises a first ceramic alumina comprising a loose pack density of 1.6-1.8 g/cc, and wherein the second type of abrasive particle comprises a second ceramic alumina comprising a loose pack density within a range of 1.78-1.88 g/cc.

2. The method of forming an abrasive article of claim 1, wherein the first ceramic alumina comprises a sol-gel alumina grain.

3. The method of forming an abrasive article of claim 1, wherein the first ceramic alumina comprises an exploded grain.

4. The method of forming an abrasive article of claim 1, wherein the first ceramic alumina comprises a dopant including magnesium oxide (MgO) in an amount of not less than 0.5 wt % and not greater than 10 wt %.

5. The method of forming an abrasive article of claim 1, wherein the second ceramic alumina comprises a sol-gel alumina grain.

6. The method of forming an abrasive article of claim 1, wherein the second ceramic alumina comprises a roller crushed grain.

7. The method of forming an abrasive article of claim 1, wherein the first ceramic alumina comprises an average crystallite size of not less than 0.01 μm and not greater than 1 micron.

8. The method of forming a method of forming an abrasive article of claim 7 wherein the second ceramic alumina comprises an average crystallite size of not less than 0.01 μm and not greater than 1 micron.

9. The method of forming an abrasive article of claim 1, wherein the first type of abrasive particle and the second type of abrasive particle comprise randomly shaped abrasive particles, irregularly shaped abrasive particles, or a combination thereof.

10. The method of forming an abrasive article of claim 1, wherein the second type of abrasive particle comprises a roller crushed grain, wherein the first type of abrasive particle comprises an exploded grain, and wherein the additive particle comprises brown fused alumina ($Al_2O_3$).

11. The method of forming an abrasive article of claim 1, wherein the blend of abrasive particles comprises an average friability difference, $\Delta|F32-F2|$, within a range of at least 6.25% to not greater than 17.5%.

12. The method of forming an abrasive article of claim 1, wherein the brown fused alumina comprises a fracture toughness higher than a fracture toughness of each of the first type of abrasive particle and the second type of abrasive particle.

13. The method of forming an abrasive article of claim 2, wherein the blend comprises at least 1 wt % and not greater than 40 wt % of the first type of abrasive particle for the total weight of the blend.

14. The method of forming an abrasive article of claim 11, wherein the blend comprises at least 1 wt % and not greater than 50 wt % of the first type of abrasive particle for the total weight of the blend.

15. The method of forming an abrasive article of claim 1, wherein the blend comprises at least 1 wt % and not greater than 40 wt % of the additive particle for the total weight of the blend.

16. The method of forming an abrasive article of claim 1, wherein the first type of abrasive particle comprises an average friability, $F_1$, of at least 0.55 and not greater than 0.6.

17. The method of forming an abrasive article of claim 1, wherein the second type of abrasive particle comprises an average friability, $F_2$, of at least 0.62 and not greater than 0.7.

18. The method of forming an abrasive article of claim 1, wherein the first type of abrasive particle comprises an average particle size, D50T1, wherein the second type of abrasive particle comprises an average particle size, D50T2, and further comprising an average particle size difference, $\Delta D50=|D50T1-D50T2|$, of not greater than 600 μm.

* * * * *